US005337996A

United States Patent [19]

Kalish

[11] Patent Number: 5,337,996

[45] Date of Patent: Aug. 16, 1994

[54] PORTABLE EASEL SYSTEM

[76] Inventor: Milton Kalish, 5001 Garvin St., Richmond, Calif. 94805

[21] Appl. No.: 4,251

[22] Filed: Jan. 14, 1993

[51] Int. Cl.[5] ..... A47B 97/04

[52] U.S. Cl. ..... 248/460; 248/448; 248/461

[58] Field of Search ..... 248/441.1, 444.1, 442.2, 248/451, 452, 454, 455, 456, 460, 461, 463, 465, 448

[56] References Cited

U.S. PATENT DOCUMENTS

| | | | |
|---|---|---|---|
| 831,766 | 9/1906 | Bing | 248/461 |
| 889,863 | 6/1908 | Tzschachmann | 248/465 |
| 2,064,232 | 12/1936 | Tepper | 248/460 X |
| 2,550,550 | 4/1951 | Goodstein | 248/465 X |
| 3,031,247 | 4/1962 | Schieve | 248/461 X |
| 3,076,645 | 12/1943 | Neuwirth | 269/154 |
| 3,249,383 | 5/1966 | Geller | 248/461 X |
| 3,304,045 | 2/1967 | Bethoney | 248/451 |
| 4,171,116 | 10/1979 | Carver et al. | 248/464 |
| 4,326,687 | 4/1982 | Clyburn | 248/168 |
| 4,482,185 | 11/1984 | Zoeller | 248/455 X |
| 4,609,174 | 9/1986 | Nakatani | 248/465 |
| 4,690,363 | 9/1987 | Koves | 248/454 X |
| 4,826,125 | 5/1989 | Kelley | 248/463 |
| 5,005,795 | 4/1991 | Holmgren | 248/455 X |

FOREIGN PATENT DOCUMENTS

| | | | |
|---|---|---|---|
| 648047 | 12/1950 | United Kingdom | 248/460 |
| 1234593 | 6/1971 | United Kingdom | 248/452 |
| 1568970 | 6/1980 | United Kingdom | 248/460 |

*Primary Examiner*—J. Franklin Foss

[57] ABSTRACT

A lightweight structure for oil and acrylic painting that converts to a self-contained backpack, capable of transporting a canvas, paint supplies and the like. The structure is composed of three legs (31L, 31R, 31B) joined at the top, braced by a detachable pack frame (175) suspended between the legs near the middle, with each adjacent pair of legs crossbraced by flexible non-resilient cords (71L, 71R, 71B) between the bottom of each leg and the approximate junction between each adjacent leg and the pack frame. The system is comprehensive, including pallet (267), solvent jar (268) and brush racks (191, 193), all suspended from the pack frame exterior. All paint supplies are securely held, readily accessible from the painting position in front. The canvas is rapidly moved up and down by pivoting canvas supports (300) on the legs, and a canvas support rig (376) sliding on a mast (37) above the legs. Canvas upper corners can be stabilized with a canvas stabilizer rig. Stability in the wind is achieved by staking out the tripod from the approximate midpoint of each leg, staking out the canvas support rig, hooking the canvas to the pivoting canvas supports, and by staked-out wind rigs (584, 594) clamped to the stretcher bars. The tripod and pack can be used separately, as easel and paintbox. A box-like shell pack (600) or horizontal member (467) also can be used to brace the tripod.

31 Claims, 14 Drawing Sheets

PORTABLE EASEL SYSTEM

BACKGROUND

1. Field of Invention

This invention relates to portable easels, specifically to a lightweight easel system with improved means of transport, improved wind stability, improved means of raising and lowering the canvas, and improved storage and access of materials for acrylic or oil-on-canvas painting. The system is composed of components that can be used together, or separately.

2. Discussion of Prior Art

Heretofore, attempts to design portable equipment for landscape painting include the traditional wooden French paint-box easel, a smaller paint-box easel with shoulder straps, and folding aluminum easels.

The traditional French wooden paintbox-easel is heavy and cumbersome, weighing over 12 pounds without art materials, and is carried by a handle. The apparatus consists of a wooden paintbox fitted with two collapsible front wooden legs pivotally joined with thru-bolts to each side of the paintbox front end, and a back leg pivotally attached to the back that folds into a bottom slot. The hinged lid can be stood upright, with adjustable wooden devices to hold a canvas. The drawer is subdivided into compartments for art materials, with additional compartments beneath the drawer. A pallet is included.

The unopened apparatus is unstable when placed upright on the ground due to the protruding drawer handle. It must be carefully balanced during assembly and disassembly, which can be risky with a wet painting mounted on the easel. The nut-and-bolt fasteners for the legs and lid are tedious. The legs are assembled while stooping or squatting to loosen and re-fasten seven wingnuts. Raising and lowering the canvas while painting is time consuming. Only 50% of the art materials are accessible from the painters position in front of the easel. If the drawer is used to support the pallet, the materials within are completely inaccessible. There is no means to safely hold brushes charged with paint, which must be hand held or balanced precariously on the drawer or pallet. This arrangement is especially awkward when the painter needs to squeeze more paint from a tube, necessitating either walking to the side to rest the pallet on the open box, covering up even more materials, or squatting and putting everything on the ground. There is no provision for essential jars of solvent. There is no means to mount a canvas over three feet in height. The apparatus is somewhat stable in the wind only due to its heavy weight. It is annoying to carry the heavy apparatus to a setting such as a class where just a paintbox is required. However, one advantage is that the pivoting lid lowers to a horizontal position for watercolors.

A smaller version of the traditional paintbox was developed to compensate for the weight. It weighs 8.5 pounds and is fitted with thin uncomfortable leather shoulder straps, but no waist belt. In addition to all of the above disadvantages, there is very little space for paint supplies.

Although there has been no subsequent development of the paintbox easel, significant improvement has occurred in portable folding easels. Lacking a paintbox entirely, aluminum folding easels are lighter. Typically they comprise an upright tripod supporting arrangement, with adjustable legs, and with means to support a stretched canvas. The wobbly lightweight legs are often supported by pivotal tie-bars, pivotally connected to a central hub, or by braces. Such easels typically fold to approximately three feet long, and weight at least three pounds. Canvas and paintbox must be carried separately, the paintbox placed awkwardly on the ground for use. Nakatani's easel features a snap down tee-shaped internal rigidifier sufficient to support a paintbox at a convenient height while painting, but not during transport. Lightweight aluminum folding easels are almost never displayed in stores with a full set of painting materials, because the problem of transport would be glaringly obvious.

Lightweight modern easels easily blow over in the wind. Some are furnished with stakes at the leg bottoms that can be stuck into the ground, but often these do not solve the wind problem, because staking the bottom of the easel yields the least leverage against the wind pushing on the canvas at the top. Attached stakes are cumbersome because the easel leg can be placed only where the ground is sufficiently soft. Neuwirth's easel clamp is more secure in the wind, but obscures an annoyingly large area of the canvas upper edge, and the leg mounted lower canvas supports on such easels are awkward to adjust. On most lightweight easels, there is usually insufficient means to fasten both top and bottom of the canvas to the easel with real security, and raising or lowering the canvas while painting is tedious. No means have been developed to brace the upper courners of a canvas to a lightweight portable easel.

A continuing need therefore exists for a comprehensive, lightweight, sturdy apparatus for landscape painting that combines convenience of transport, safe storage and convenient access to paint supplies from the painter's position in front of the easel, ease of raising and lowering the canvas, stability in the wind, and ability to mount a large canvas.

OBJECTS AND ADVANTAGES

Accordingly several objects and advantages of my invention are the creation of a comprehensive, portable system for acrylic or oil-on-canvas landscape painting, also adaptable to classroom and studio. The system is very lightweight, sturdy, compact, and comfortable to transport. It includes means to store, transport, and access all necessary materials from the painting position in front of the easel, leaving the hands completely free while painting, means to move the canvas rapidly up and down while painting, and means to secure the easel in the wind, with canvas and art materials securely fastened.

The easel system provides new operative results. Ease of transport allows the acrylic and oil-on-canvas painter convenient access to landscapes heretofore inaccessible to most artists, who paint near a road due to cumbersome, weighty equipment. The system is truly comprehensive, incorporating all necessary paint supplies. The means for securing the easel in the wind allow the painter to work solely according to the dictates of the creative process itself. The invention thus solves a number of important problems long felt in the area of painting.

The system is especially useful to artists with limited funds because the components can be adapted individually for classroom and studio painting, including means to hold and stabilize a large canvas, and for transporting materials and canvas to class without having to bring the easel tripod itself, which can be left at home with another work in progress. In addition, the appearance is appealing due to the intriguing design: a pack nestled within a triangular tripod, stabilized symmetrically by cords that create a visual triangles-within-triangles effect. The traditional paintbox-easel looks clumsy by comparison.

Further objects and advantages of my invention will become apparent from a consideration of the drawings and ensuing description of it.

DRAWING FIGURES

Figure 19:
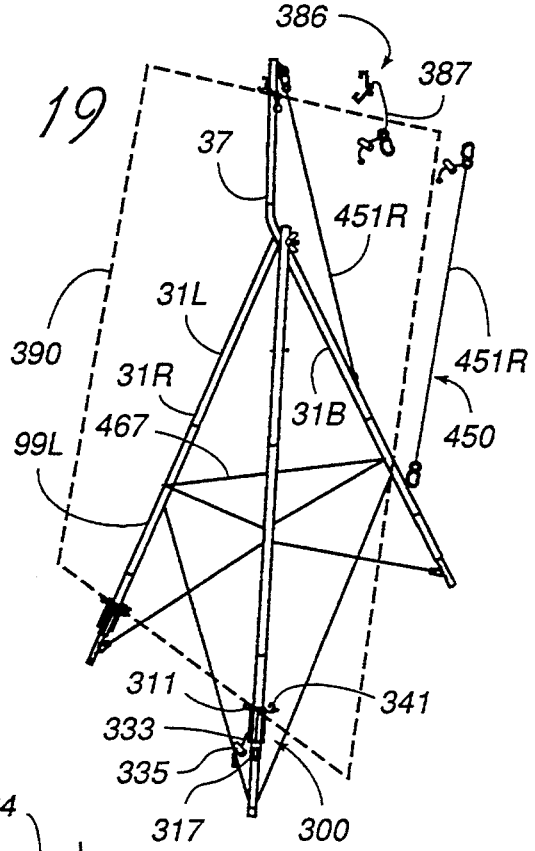

FIG. 19 includes a perspective view of a large canvas mounted on the tripod, employing the auxiliary triangular insert and canvas stabilizer rig.

Figure 20:
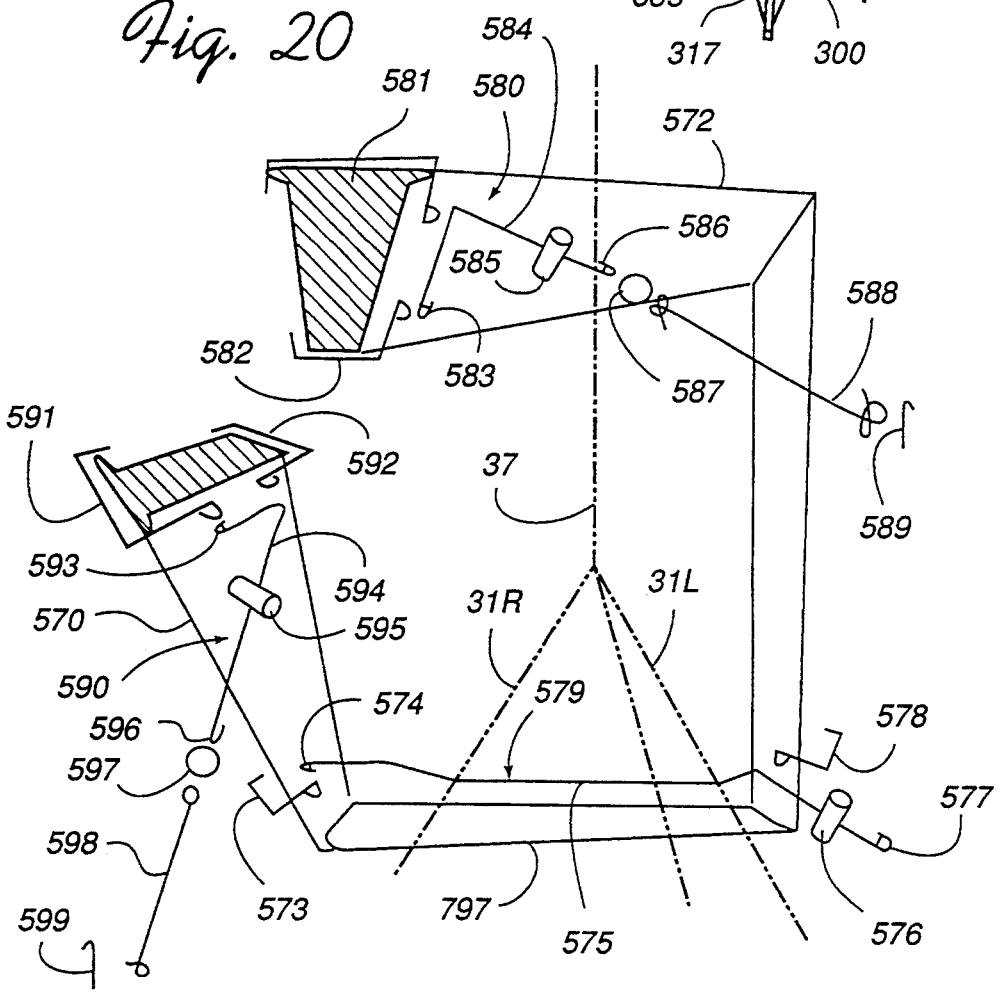

FIG. 20 is a perspective view of stretcher bars and wind rigs.

Figures 21, 22:
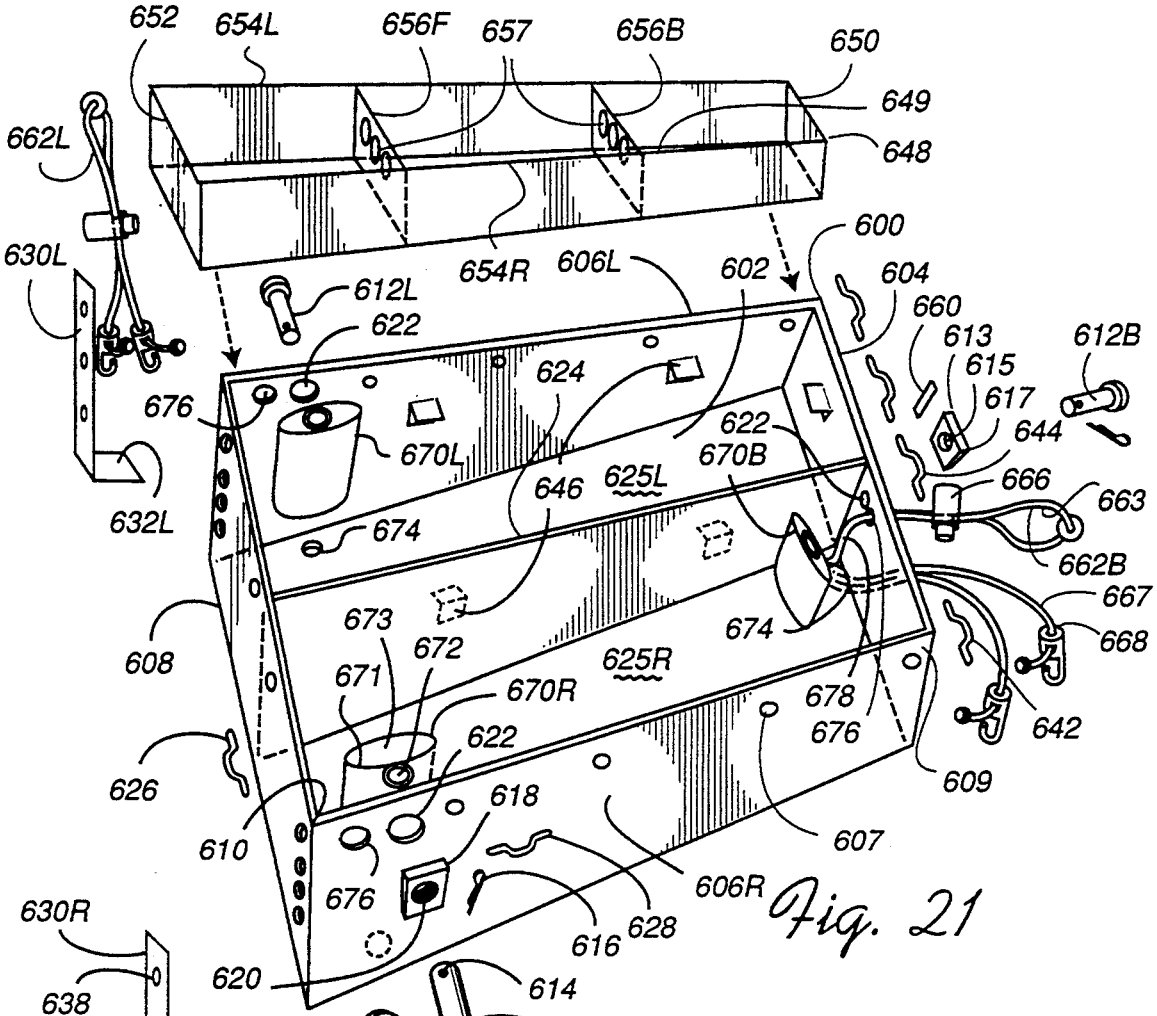

FIG. 21 is a perspective view of the shell pack.

FIG. 22 is a perspective view of the pack used as a tabletop easel.

Figure 23:
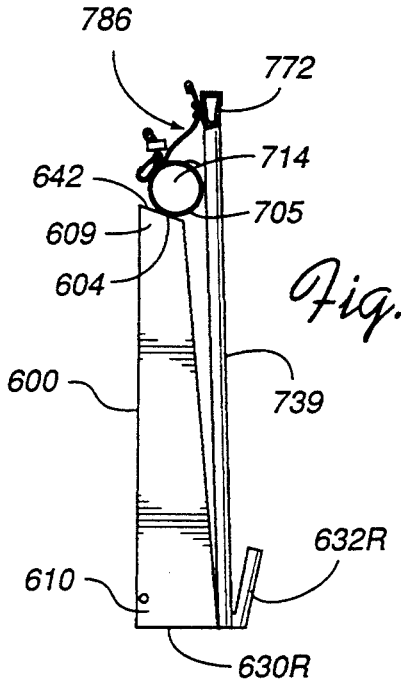

FIG. 23 is a side view of the shell pack.

Figure 24:
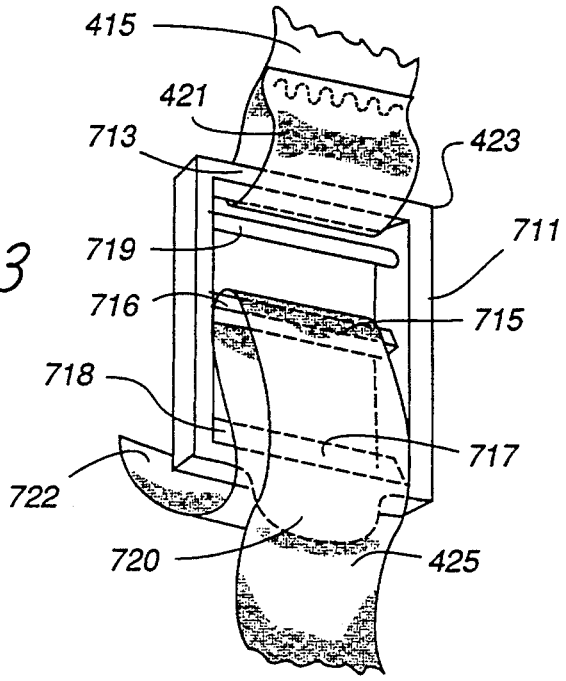

FIG. 24 is a perspective view of a standard ladder lock.

Figure 25:
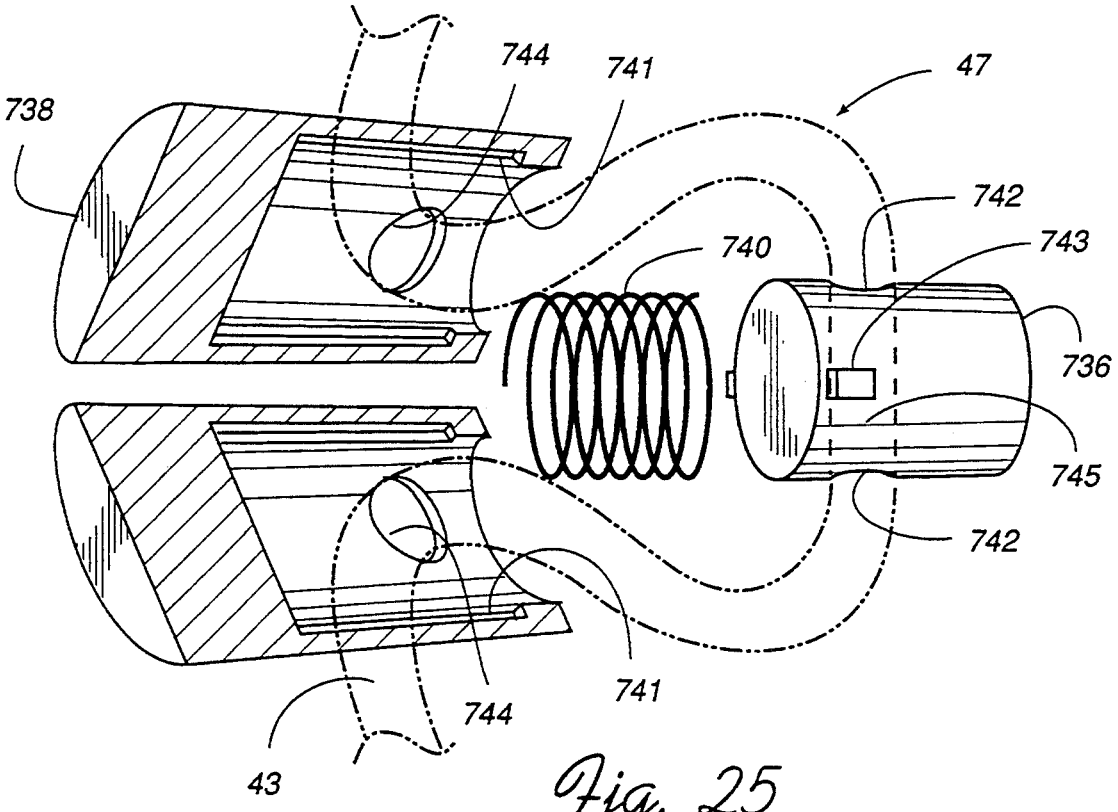

FIG. 25 is a perspective view of a cord lock.

Figure 26:
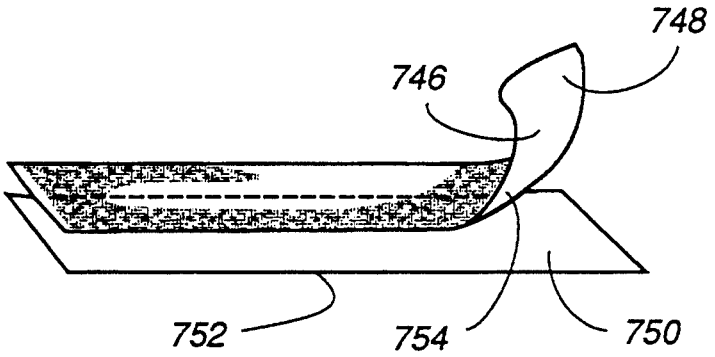

FIG. 26 is a perspective view of nylon hook-and-loop fastener.

Figure 27:
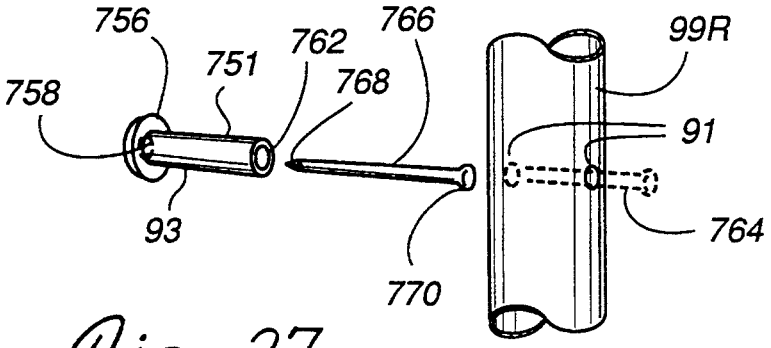

FIG. 27 is a perspective view of blind rivet fastened through leg.

Figure 28:
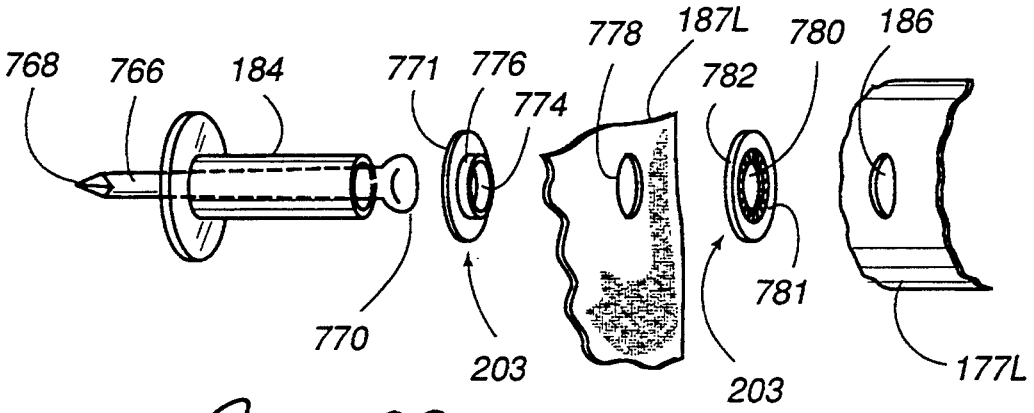

FIG. 28 is a perspective view of grommetted front hatch attached to front tube with blind rivet.

PREFERRED EMBODIMENT OF THE INVENTION

Figure 1:
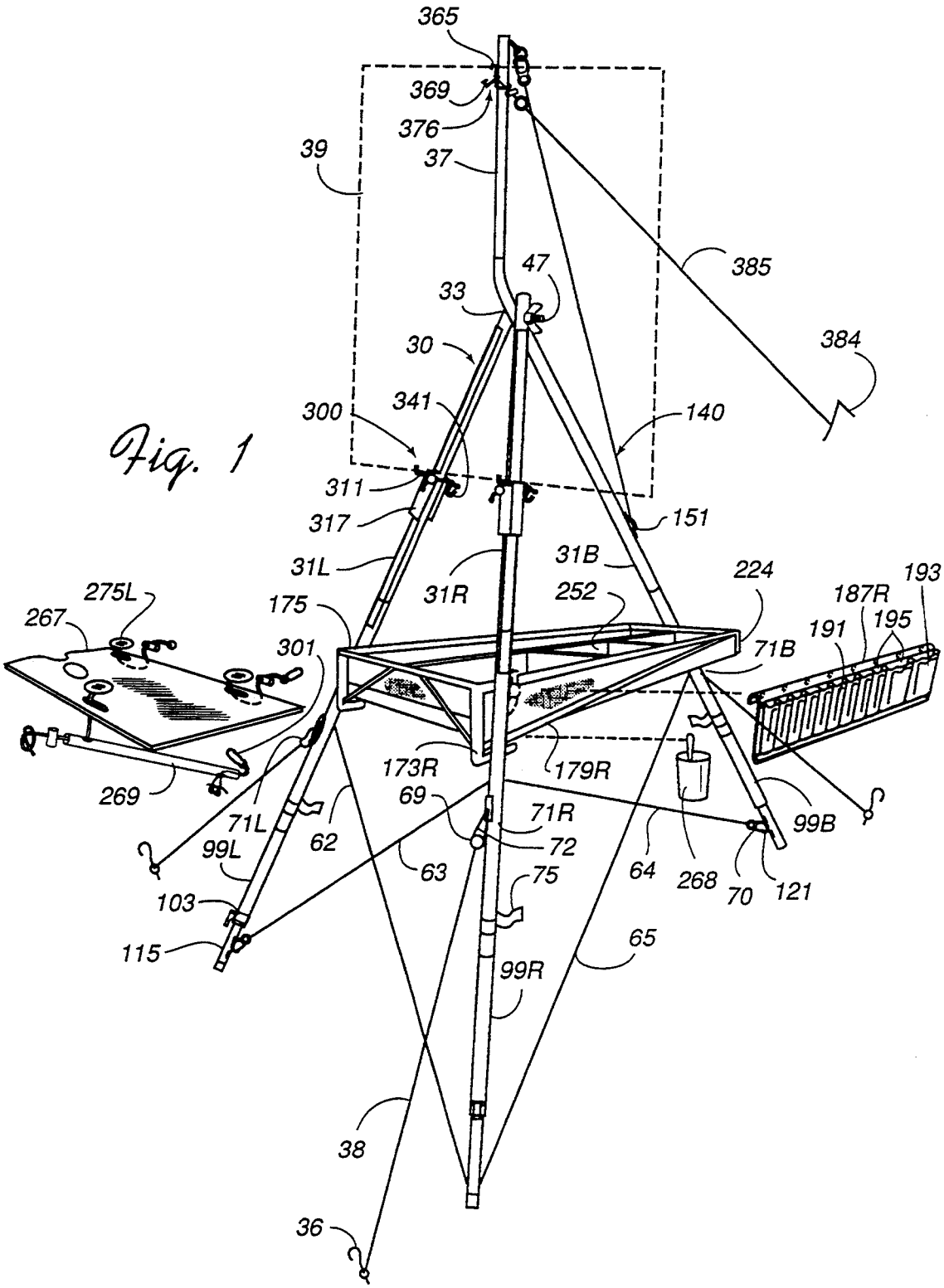
FIG. 1 is a perspective view of the easel system.
Figures 13, 14, 15:
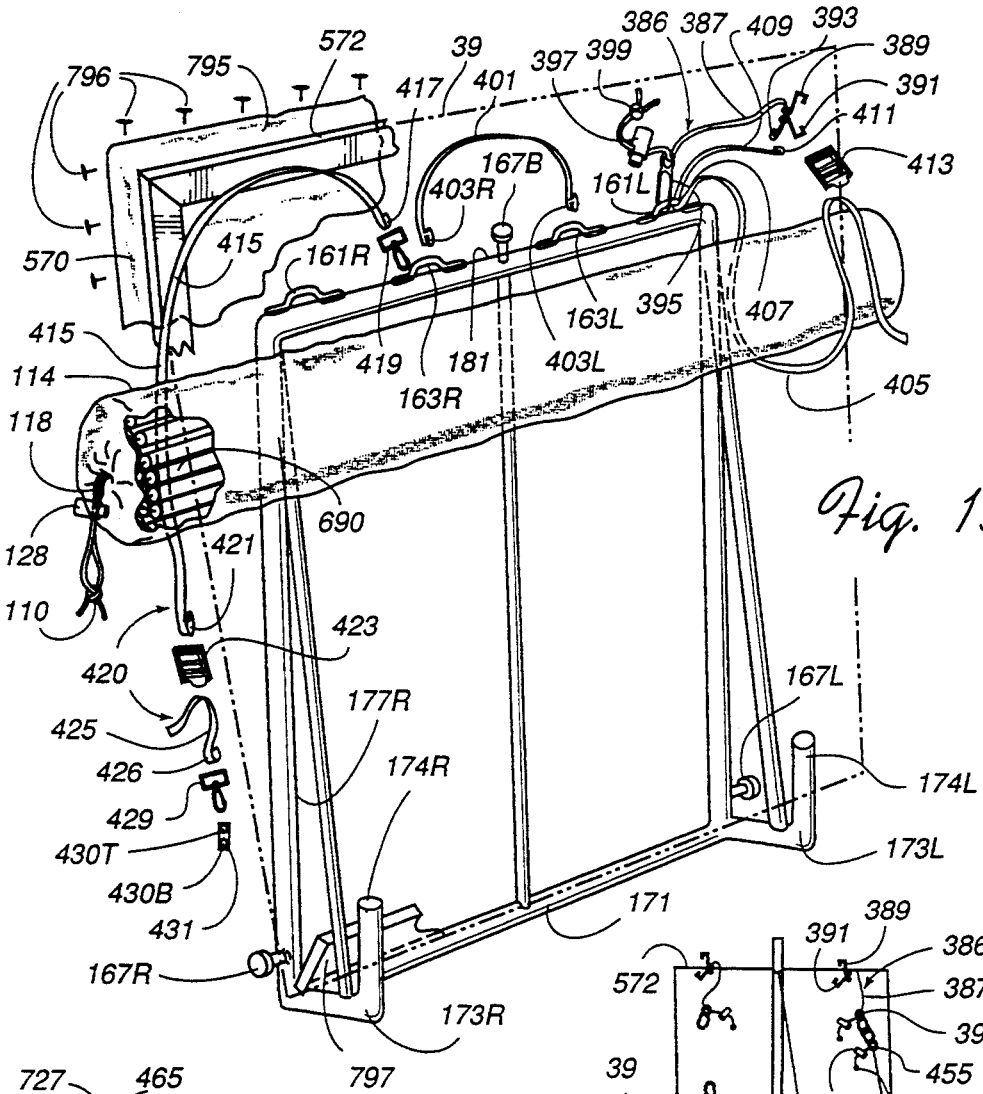
FIG. 13 is a perspective view of the solvent jar.
FIG. 14 is a perspective view of the canvas stabilizer rig.
FIG. 15 is a perspective view of the easel system as a pack, detailing the handle, canvas holdfast, shoulder straps, and waistband.

Disclosed is a brief general orientation to the easel system, as preface to the detailed description that follows. Please refer briefly to FIG. 1 and FIG. 15. FIG. 1 is a perspective view of the major components of the easel system. The major components include a tripod 30 with three legs 31L, 31R, 31B with attachments described below, a pallet 267 with attachments, and a pack frame 175 with attachments, seated horizontally within the tripod. FIG. 15 is a rear perspective view of the easel system as a pack, ready for transport. FIG. 19 is a perspective view of the tripod used separately, and FIG. 22 is a perspective view of the pack used separately. FIG. 20 is a perspective view of the wind rigs mounted on the stretcher bars. Now the detailed description of the invention will begin.

The Tripod: In FIG. 1, the front of the easel system faces left in the illustration. As can be seen in FIG. 1, the easel system includes a tripod 30, also seen in FIG. 4, composed of three tubular legs 31L, 31R, 31B joined at the junction with threaded rod 33. Right front leg 31R in FIG. 1 is illustrated in perspective rear view FIG. 2, with the outside right edge facing left in the illustration. The leg consists of three connecting shock corded tubular segments: upper segment 41R, middle segment 53R, and lower segment 99R.

Figure 5:
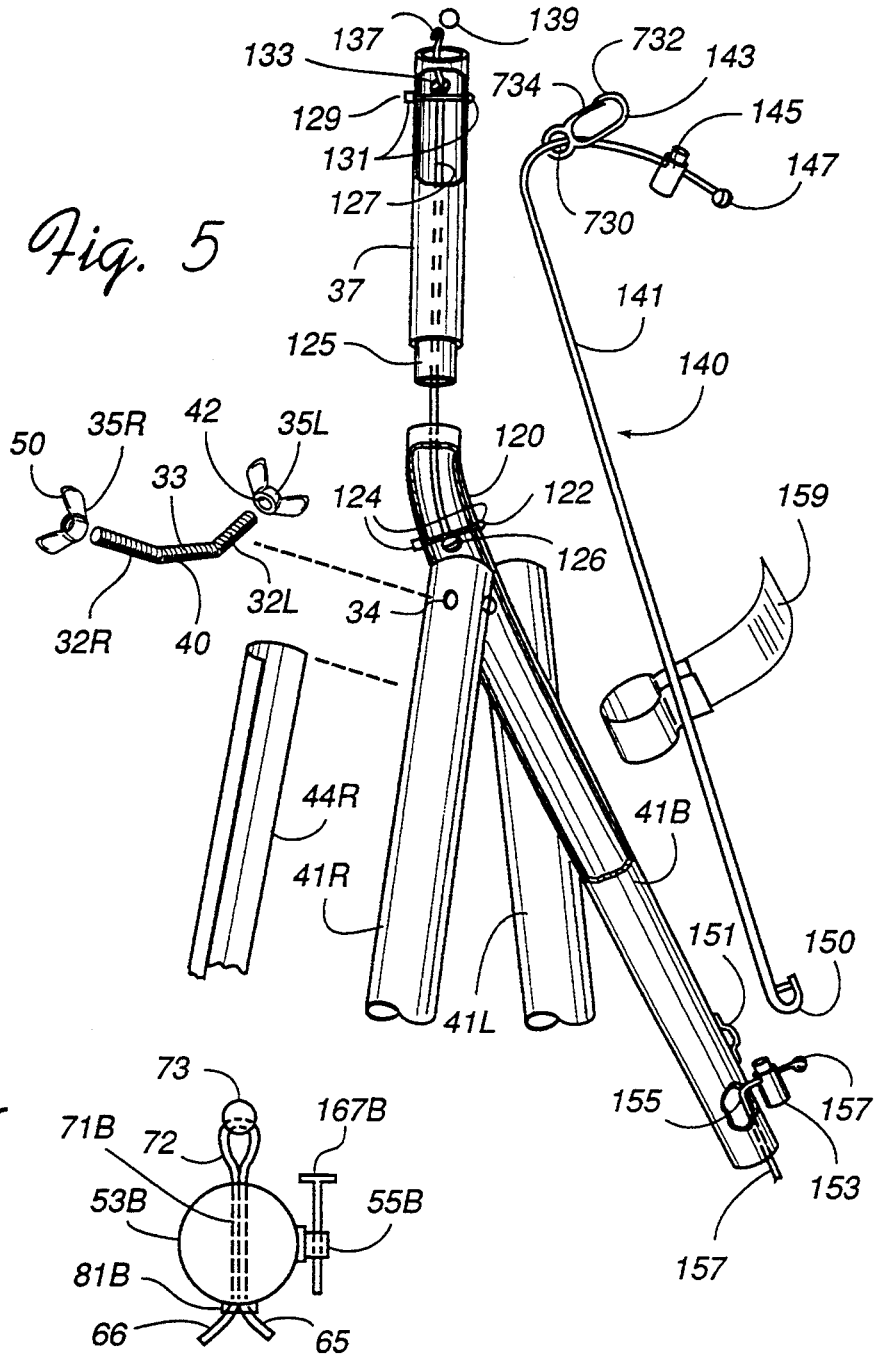
FIG. 5 is a perspective view of the junction, mast and backstay.

Turning to FIG. 5, it will be seen that the junction of the legs in FIG. 1 is illustrated in perspective view from the right rear, with the right outside edge of the right leg facing left in the illustration. Threaded rod 33, also illustrated in FIG. 1, is bent symmetrically upward at either end, with equal left and right ends 32L, 32R at acute equal angles with the rod center. Threaded rod 33 is composed of stiff material, consisting of a cylindrical rod with ridged threads 40 spiraling clockwise on the outside surface. These mate with threaded hole 42 of wingnuts 35L, 35R. The wingnut consists of a housing with a threaded hole 42 in the center, with two elongated wings 50 protruding up at an angle from opposite sides of the housing, that serve as handles. The wingnuts are fastened to the rod by placing the respective threads contiguous, and rotating the wings clockwise. To loosen, the wings are rotated counter-clockwise.

The threaded rod pivotally connects the three upper leg segments, with back leg upper segment 41B nested between left leg upper segment 41L and right leg upper segment 41R. The threaded rod traverses aligned hole 34 in each upper segment near the top, with left and right adjustable wingnuts 35L, 35R attached to the left and right ends of the threaded rod, pivotally fastening the legs on the threaded rod. The bent ends allow the legs to be spread at an angle when they are pivoted about the threaded rod.

Returning now to FIG. 2, shock cord 43 resiliently connects the three segments of the right leg. Shock cord is a cord composed of a plurality of resilient strands, encased in a protective smooth sheath that allows the cord to slide easily. The shock cord then traverses adjustable cord lock 47. Stop knot 49 at the shock cord upper end keeps cord lock 47 from slipping off the end; this applies to every stop knot contiguous with a cord lock in this patent application.

Illustrated by perspective view in horizontal position in FIG. 25, cord lock 47 is composed of rigid material. It consists of inner cylinder 736 closed at the back end, resting within outer cylinder 738, similarly closed at the back end. Two parallel horizontal ridges 741 protrude from opposite sides of the outer cylinder wall facing inside. These slide inside two mating parallel horizontal grooves 743 in the inside cylinder wall facing out, which slide along the ridges. But the grooves cannot pass protruding stop wall 747 that rings the outer cylinder open end, thereby fastening the inner cylinder within the outer cylinder. Spring 740 sits inside the outer cylinder closed bottom end, and the inner cylinder wall open edge rests against it, the spring pushing the two cylinders apart. Pinching the cylinders together with the fingers aligns paired holes 742 with paired holes 744 in the respective cylinder walls, located 90 degrees around the cylinder walls from the respective ridges and grooves. The aligned holes create an unimpeded passage 745 for cord 43 (or two cords, or a thin strap) through the paired holes in the contiguous inner and outer cylinders as the cord lock is slid along the cord. This is most easily done when the cord is pulled taut. When the cylinder walls are released, the holes in the respective cylinders are pushed in opposite directions against the cord by the spring, thereby automatically locking the cord(s) in position within the holes. All cord locks in this patent application are identical in structure and operation with cord lock 47.

Returning to FIG. 2, the shock cord then traverses hole 48 in the outside wall below the threaded rod, through the interior of upper segment 41R, connecting tube 51, interior of middle segment 53R, connecting tube 89, into the top end of lower segment 99R, where the bottom end of the cord is anchored by stop knot 95 below blind rivet 93, fastened through hole 91.

Figure 2:
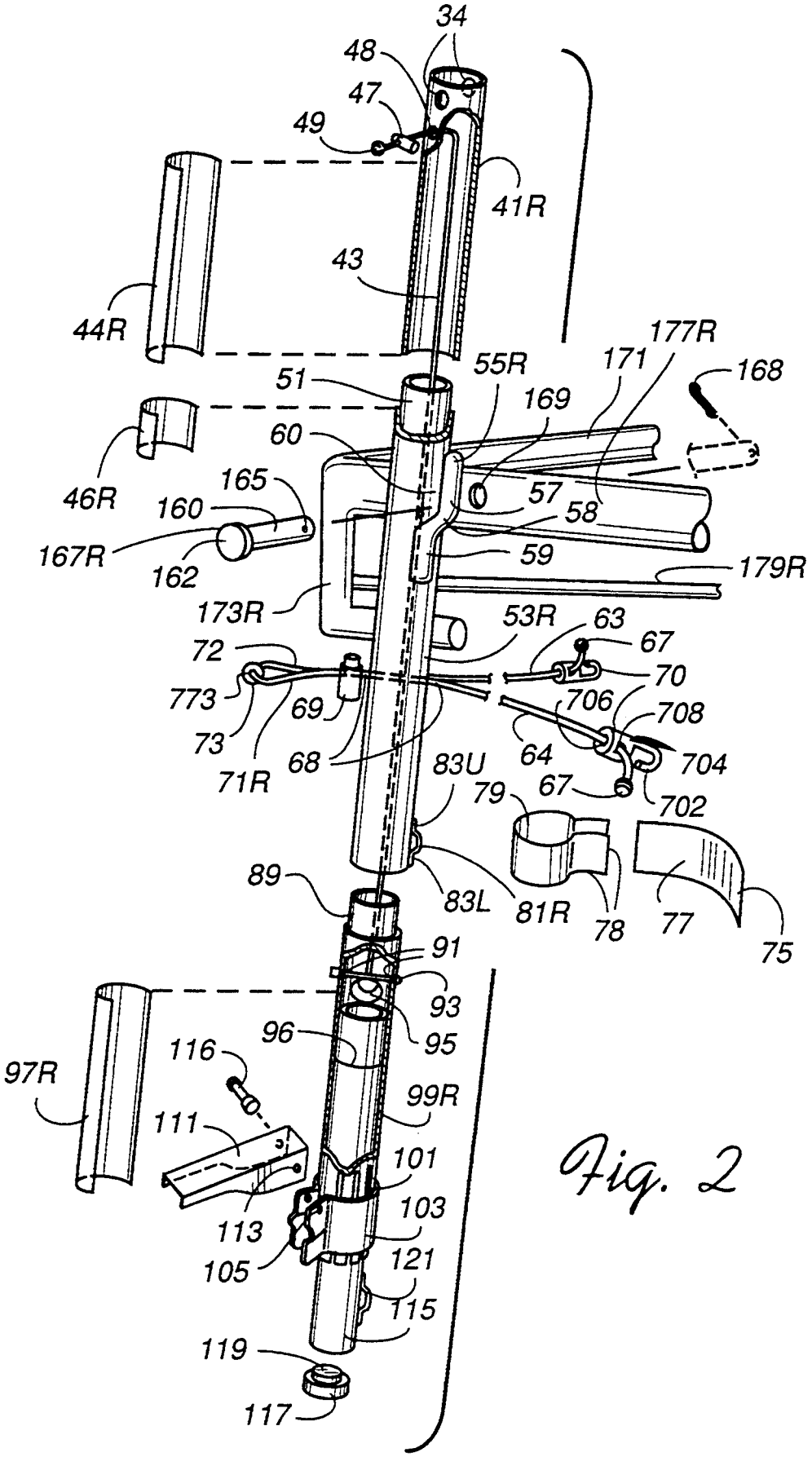
FIG. 2 is a perspective view of the right leg.

As illustrated in perspective view in FIG. 27, blind rivet 93 consists of a hollow shaft 751 of stiff material with disk shaped head 756 at one end, the shaft and head traversed by a hole 758. The shaft is inserted through hole 91 on leg segment 99R, also illustrated in FIG. 2. The end of the shaft 762 is enlarged 764 by a tool, such that the rivet cannot slip out of the hole. The tool usually consists of a finishing nail 766, with the pointed end 768 protruding from the rivet head, as seen in FIG. 28, and the round head 770 resting against the rivet shaft open end. When the pointed end is pulled out from the rivet head, the round head expands the shaft inside the hole, then breaks off so the pointed end can be withdrawn. In FIG. 2, blind rivet 93 forms a stiff horizontal barrier through the vertical tube interior, where stop knot 95 is too large to slip past. Similarly with all other stop knots contiguous with blind rivets in this patent application.

The top end of middle segment 53R is removably connected to the upper segment with connecting tube 51. The connecting tube is a stiff tube segment, glued protruding upward from the middle segment interior, and inserts into the upper segment bottom end.

Figure 6:
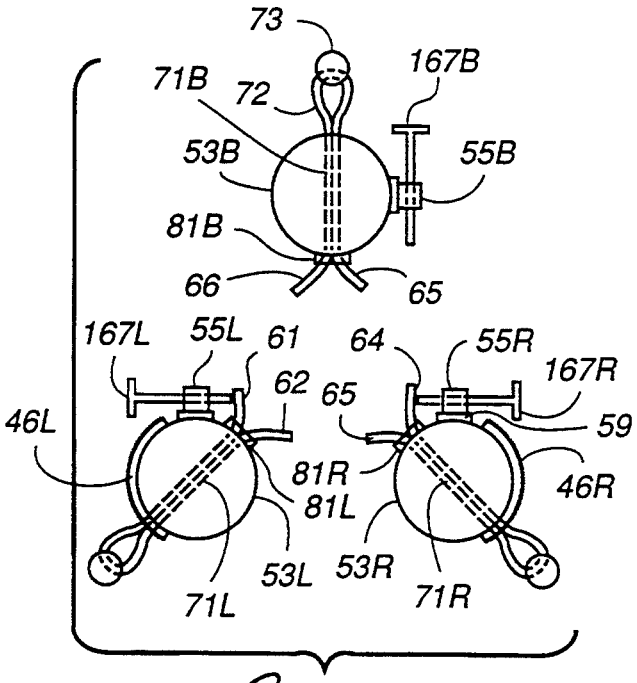
FIG. 6 is a top view of the middle segment attachments.

Support arm 55R consists of a vertical piece of rigid material, subdivided into upper segment 57, middle segment 58, and lower segment 59. The lower segment is welded to the tube exterior facing back, as also illustrated in FIG. 6. The middle segment 58 angles up and away from the leg at an acute angle, and the upper segment 57 is parallel to the leg. Notch 60 between the support arm and the leg aligns with clevis pin 167R protruding from side tube 177R, described in FIG. 8 below.

Right leg crossbracing cord 71R is a non-resilient cord looped in the middle, with outside loop 72 traversing middle segment hole 68, near the junction between the leg and the pack frame facing out, just far enough below the support arm to keep the crossbracing cords clear of the pack frame. A cord is an elongated flexible member with a round cross section, capable of bearing tension along the length. When the easel system is standing as in FIG. 1, left facing end 63 and right facing end 64 protrude from the inside of the hole, as best illustrated in FIG. 6 described below. Returning to FIG. 2, the looped portion protruding out from the leg traverses cord lock 69, and the two ends as a single strand traverse hole 773 in bead 73. The bead is a round stiff object traversed by the hole. On the inside of the leg, the left and right facing cross-bracing cord ends are attached to bungee-cord hooks 70.

Bungee-cord hook 70 has hook 702 at the front end of cylindrical housing 704, with hole 706 in the back end and two arch-shaped windows 708 opposite each other on the cylinder walls. Cord 64 passes through the hole and out one window, where it is anchored with stop knot 67, that rests against the inside of hole 706 when the cord is extended.

Tab 75 is attached to the middle segment above anchor 81R. The tab consists of two strips of nylon hook-and-loop fastener. These include hook surface strip 79, fastened with adhesive around the segment with hooks facing out, and with ends 78 protruding. Loop-surface strip 77 flexibly protrudes away from the leg, attached with sewn thread to the protruding ends.

A perspective view of typical mating strips of nylon hook and loop fastener are illustrated in FIG. 26. The mating strips include loop-sided strip 752, with a plurality of tiny nylon loops 750 protruding out, and hook-sided strip 746, with a plurality of tiny nylon hooks 748 protruding out in rows. The tiny loops are hooked 754 when the strips are pressed together by hand, and rapidly detach when pulled apart. These descriptions and procedures apply to every mating strip of nylon hook and loop fastener in this patent application.

Returning to FIG. 2, loop-sided strip of nylon hook-and-loop fastener 44R is attached vertically to the outside right edge of the upper segment, extending from below hole 34 to the upper segment bottom end. A second loop-sided strip 46R is attached vertically to the right outside edge of the middle segment tube, extending from the middle segment top end to a point above support arm 55R. The two strips are contiguous when the leg segments are joined together. Strip 46R is also illustrated in FIG. 6.

Anchor 81R is located at the middle segment bottom inside edge, consisting of a vertical rigid segment, with upper and lower feet 83U, 83L welded to the leg, the middle portion between the ends curving away from the leg, parallel to it. The anchor faces into the tripod, as illustrated in FIG. 6.

The bottom end of middle segment 53R is removably connected to the top end of lower segment 99R by connecting tube 89. The connecting tube is a stiff tube segment, glued protruding from the lower segment inside top end, which inserts onto the middle segment bottom end. Loop-sided strip of nylon hook-and-loop fastener 97R is attached vertically to lower segment right side, extending to a point above clamp housing 103.

Figure 3:
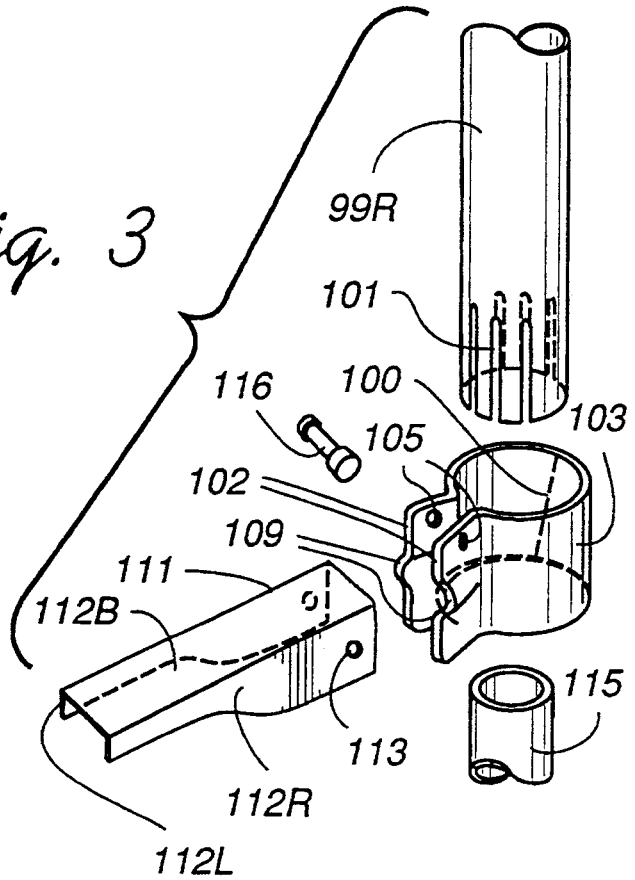
FIG. 3 is a perspective view of the leg extension clamp.

FIG. 3 is a perspective view of the clamping arrangement for leg extension 115, also seen in FIG. 2 and FIG. 1. A plurality of parallel vertical clamping slots 101 are cut into the lower segment 99R bottom end. Clamp housing 103 consists of a rigid circular strip with a vertical opening. Parallel vertical clamp walls 102, protrude out at an approximate right angle from each side of the opening. The middle portion of the outside edge of each clamp wall curves outward from the opening, to form clamp mounds 109. The housing girdles the slotted bottom end with the vertical mid-line 100 welded to the lower segment. Clamp lever 111 consists of flat rectangular back surface 112B, with left and right parallel walls 112L, 112R protruding vertically downward on each side. The walls are deeper at the front end, pierced by paired holes 113. These mate with paired holes 105 in the clamp housing walls above the clamp mounds, the clamp handle pivotally joined to the clamp housing by blind rivet 116.

Returning to FIG. 2, leg extension 115 is a tubular segment housed within lower segment 99R, with outside diameter slightly less than the lower segment inside diameter, held in place by the clamping arrangement described above. Marker line 96 is inscribed on the outside surface near the top end. Anchor 121, identical to anchor 81R described above, is welded vertically to the leg extension near the lower end. Disk-shaped inserting segment 119 of disk-shaped rubber tip 117 is attached with adhesive inside the leg extension bottom end. Returning to FIG. 1, left leg 31L is a mirror image of the right.

But back leg 31B is different. The back leg upper segment is best illustrated in FIG. 5, and the middle segment in FIG. 6. In FIG. 5, back leg upper segment 41B is positioned between the front leg upper segments 41L, 41R at the pivotal junction, also illustrated in FIG. 1. The back leg extends below threaded rod 33 at an angle, but bend 120 above the threaded rod aligns the top end vertically. Tubular mast 37 is vertically attached to the back leg top end by connecting tube 125. The connecting tube is a stiff tube segment glued protruding from the mast bottom end inside surface, and inserts into the back leg top end. Shock cord 127 is anchored inside the mast by stop knot 133 above blind rivet 129 fastened through hole 131. The shock cord continues upward from stop knot 133, to protrude above the mast top end connected to ring 139 with sewn loop 137. A ring is a stiff round flat member. A sewn loop is a looped segment of cord or strap fastened closed with sewn thread. The shock cord traverses the mast interior and the back leg upper segment, anchored above the threaded rod by stop knot 126 below blind rivet 122, fastened through hole 124. Tab 159, identical to tab 75 in FIG. 2 described above, is attached to the back leg upper segment above anchor 151.

Backstay 140 is comprised of cord 141, glove hook 143 and cord lock 145. The lower end is attached with sewn loop 150 to anchor 151. Anchor 151 is an exact copy of anchor 81R in FIG. 2, described above, vertically welded to the lower back leg upper segment facing rear. The backstay cord upper end traverses the loop of glove hook 143, cord lock 145, and ends in stop knot 147.

Glove hook 143 is made of stiff material, composed of loop 730, with hook 732 attached to one side of the loop, and snapping tongue 734 attached to the other side. The end of the snapping tongue rests against the tip of the hook, and locks objects inside. The hook is operated by hand, pressing an object past the snapping tongue into the area between the hook and tongue, which snaps shut. The tongue is pressed open with the fingers to release the hook from the objects locked within. All glove hooks in this patent application are similar in structure and operation to glove hook 143.

Shock cord 157 joins the back leg upper, middle and lower segments. The shock cord top end traverses hole 155 in the back leg upper segment back edge, cord lock 153, ending in stop knot 152. The shock cord bottom end is anchored inside back leg bottom segment 99B in FIG. 1, identical to the bottom segment of right leg bottom segment 99R in FIG. 2 described above, with a stop knot secured under a blind rivet fastened horizontally through the back leg bottom segment.

The left, right and back middle segments 53L, 53R, and 53B differ in the respective orientations of the support arms, crossbracing cords and anchors, as is best illustrated by top view in FIG. 6. When the easel system is standing, back leg support arm 55B faces right, and back leg crossbracing cord 71B traverses the back leg facing front and back. Back leg anchor 81B faces front. But for right middle segment 53R, support arm 55R faces back, crossbracing cord 71R traverses the leg from the outside facing inside toward the middle of the tripod. Nylon hook-and-loop fastener strip 46R faces right, and anchor 81R faces inside. Left middle segment 53L is a mirror image of the right.

Figure 7:
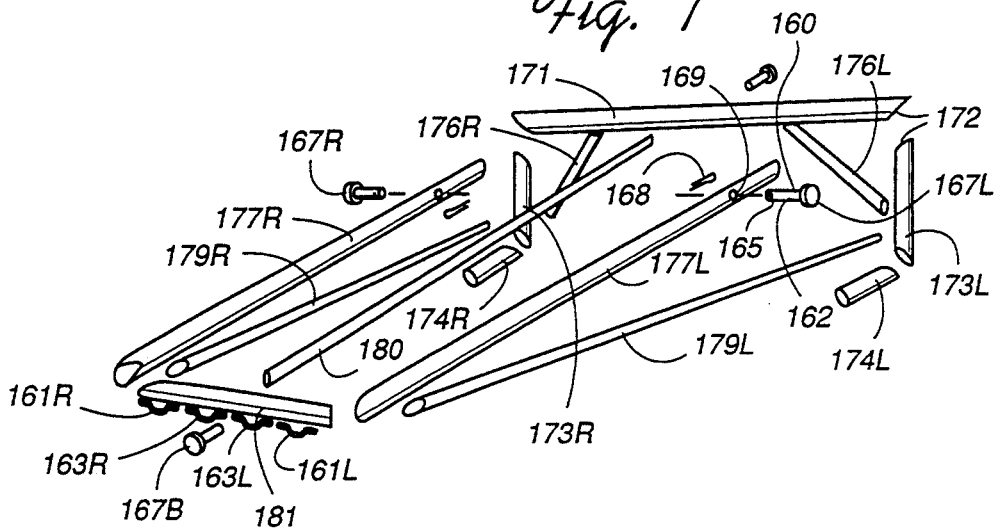
FIG. 7 is a perspective view of the pack frame components.

The Pack Frame: FIG. 7 is a perspective view of pack frame components, also illustrated in FIG. 1, FIG. 8, FIG. 15, and FIG. 16. Please note that in FIG. 7, the frame is illustrated from the back in horizontal position. The front end faces the upper right corner of the illustration, and the right side appears on the left. Beginning at the front, the ends of horizontal front tube 171 are welded respectively to top ends of left and right vertical down tubes 173L, 173R at right angles. The angle is formed by mating 45 degree angled ends of each joined tube: mating angles 172 between the front tube and the left down tube are delineated in the illustration.

Figure 16:
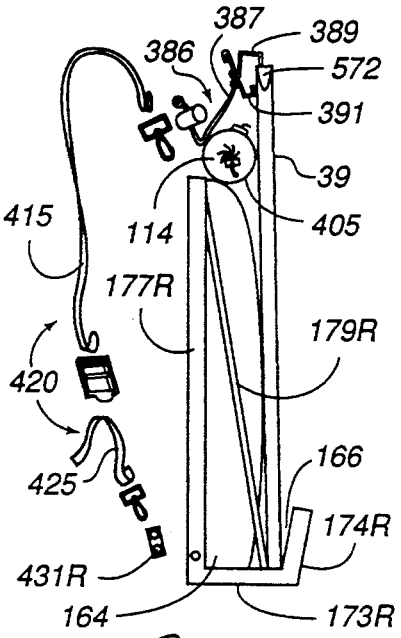
FIG. 16 is a side view of the pack, showing the attachment of the canvas to the pack.

The parallel left and right down tubes extend downward from each side. The lower ends are welded to left and right backstops 174L, 174R respectively. Turning to FIG. 16, it will be seen that they mate at an obtuse angle 166. The backstop back ends are cut square, with rounded outside edges.

Returning to FIG. 7, the back ends of parallel horizontal side tubes 177L, 177R are welded to the right and left ends of horizontal back tube 181. Each side tube intersects the back tube at a horizontal right angle, formed by mating 45 degree ends similar to 172 described above. The front ends are welded respectively to the back of the respective joints between front tube and down tubes, creating triple joints. The side tubes make right angles with the front tube. But, turning to FIG. 16, it will be seen that the side tubes make an acute angle 164 with the respective down tubes.

Returning to FIG. 7, mid-tube 180 is welded between the midpoints of the front tube and back tube. Welded left and right side support rods 179L, 179R extend from the respective side tube lower surfaces near the back tube, to the adjoining down tube back surfaces, above the backstop, also illustrated in FIG. 16. Welded left and right front support rods 176L, 176R extend at approximately 45 degrees from a point on the left and right down tube inside edges above the backstop, to the adjoining front tube lower surfaces. The front support rods are of smaller diameter than the front tube, and do not extend to the front tube front edge.

Left and right clevis pins 167L, 167R are inserted through horizontal side tube holes 169 behind the front tube. As also illustrated in FIG. 2, right clevis pin 167R consists of disk-shaped head 162 connected to the pin shaft 160 protruding out, and hole 165 in each clevis pin is locked with cotter pin 168 inside the frame. The shaft rests in notch 60 of right leg support arm 55R. Back clevis pin 167B is welded head out to the back tube midpoint, projecting back. As illustrated in FIG. 15, the left and right clevis pins anchor grommeted strap 431 of shoulder straps 420.

Returning to FIG. 7, left and right inside anchors 163L, 163R and outside anchors 161L, 161R, each identical to anchor 81R in FIG. 2 described above, are welded horizontally to the back edge, attached symmetrically about the back clevis pin.

Figure 8A:
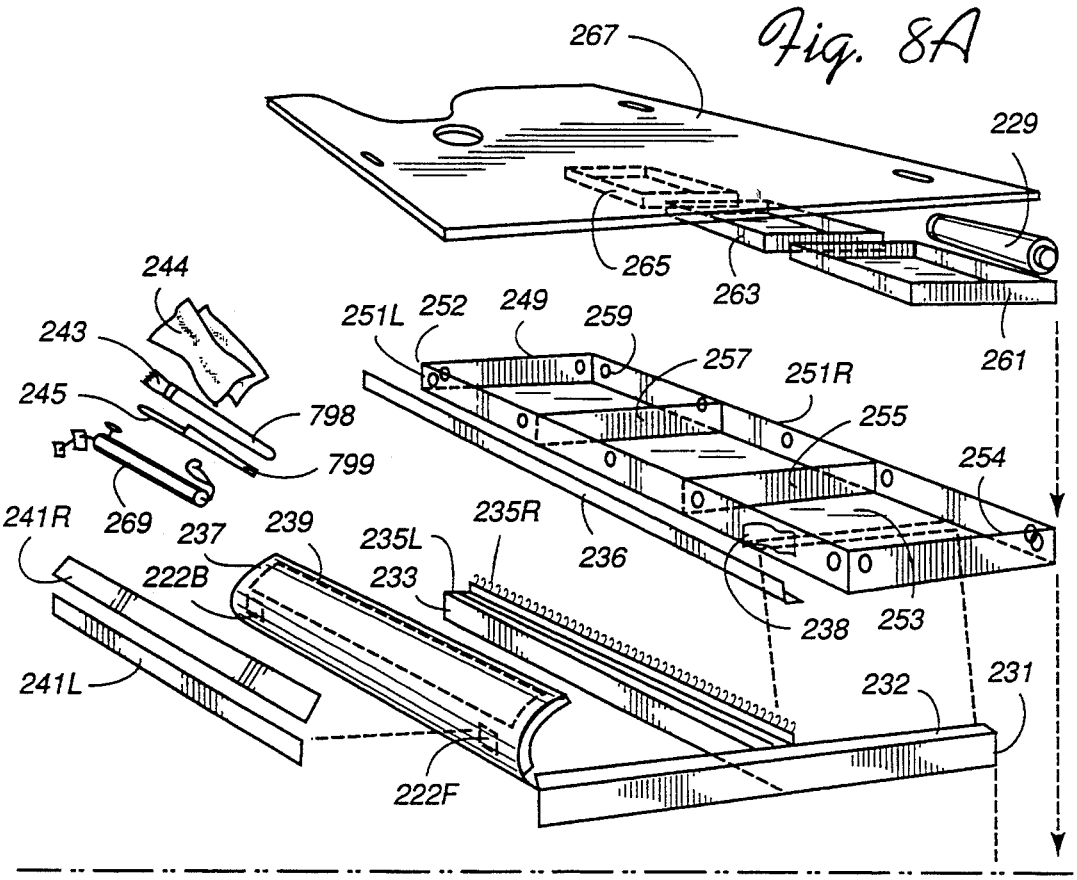
FIGS. 8A and 8B are a perspective view of the pack.
Figure 8B:
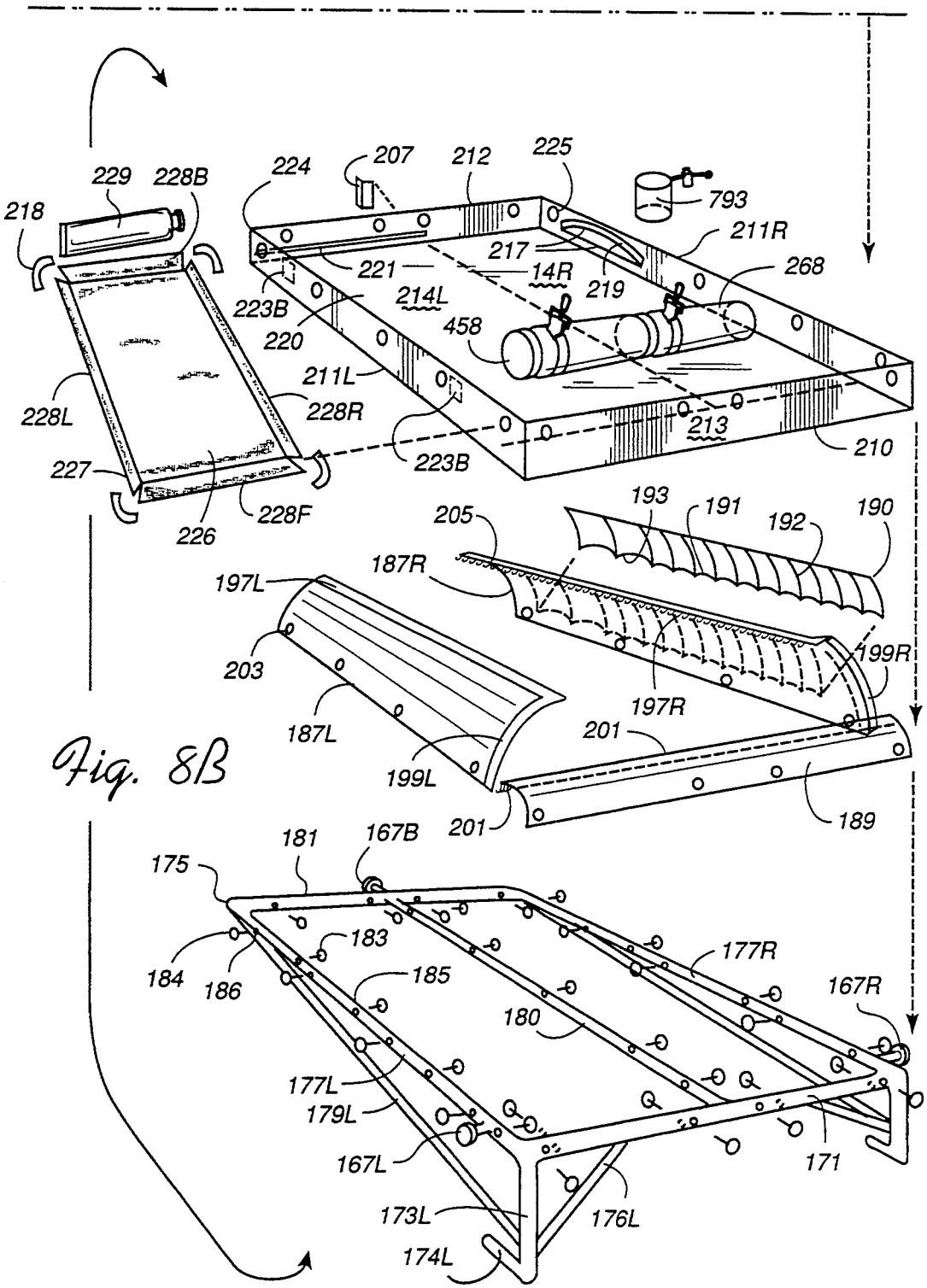

The Pack: A perspective view of pack construction is illustrated in FIG. 8. In FIG. 8, please note that inside means towards the middle of the frame. The pack is fitted with rectangular left and right hatches 187L, 187R, and rectangular front hatch 189, made of flexible material, the right hatch also illustrated in FIG. 1. Each hatch outside edge has a plurality of grommets 203.

Turning to perspective view FIG. 28, grommet 203 consists of stiff flat disk 771 with hole 774 in the center, surrounded by round collar 776 protruding up perpendicular to the disk. The collar is inserted through hole 778 to be grommeted in left hatch 187L, and through hole 780 of collar-less disk 782. The collar is pushed with a tool outward 781 from the center, onto the surface of the collar-less disk, thus fastening the grommet onto the hatch hole. The grommet reinforces the hole, thereby providing solid footing to fasten the left hatch to hole 186 of left side tube 177L with blind rivet 184, also seen in FIG. 8.

The plurality of grommets 203 on each hatch outside edge mate respectively with a plurality of corresponding holes 186 in the respective side tube and front tube outside edges, attached with blind rivets 184 described above. The left rear grommet 203 of left hatch 187L mates with rear exterior hole 186 on the left side tube, and so on with each mating consecutive grommet and hole. The left and right hatch outside edges are respectively fastened to the outside edges of side tubes 177L, 177R, extending from the back end forward to a point behind the clevis pin. The left hatch inside edge upper surface is fitted with a loop-sided strip of 197L, that mates with hook-sided strip 197R on the right hatch inside edge lower surface, allowing the overlapping hatches to mate between the side tube. Strips of nylon hook-and-loop fastener are attached to the flexible pack material with sewn thread.

Rectangular front hatch 189 extends from the front tube back past the clevis pins. The front hatch back lower edge is fitted with a hook-sided strip of nylon hook-and-loop fastener 201, that mates with adjoining loop-sided strips 199L, 199R on the left and right side hatch front upper edges, allowing the overlapping front hatch to mate with the joined left and right side hatches.

Tab 205 is a hook-sided strip of nylon hook-and-loop fastener that extends backward from the right side hatch back end inside edge. Tab anchor 207 is a loop-sided strip that mates with tab 205, sewn to the outside surface of back wall 212 described below.

A plurality of wet brush quivers 191 and at least one dry brush quiver 193 are attached with sewn thread to the right hatch inside surface, illustrated in FIG. 8 and FIG. 1. The quiver front walls are constructed from a single piece of flexible material 190, with vertical seams 192 creating adjoining vertical quivers, the common back wall being the hatch. The quiver bottom ends are closed, the open ends face up when the hatch is open, as illustrated in FIG. 1. The wet brush quivers are situated in front of the larger dry brush quiver(s). The front wall of each quiver is wider than the back wall, allowing a gap 195 between the two as seen in FIG. 1.

Returning to FIG. 8, pack body 224 is made of flexible material, and includes sloping floor 220 attached with sewn thread to rectangular vertical back and front walls 210, 212, and to left and right side walls 211L, 211R. The front wall is higher than the back wall, and the side walls are shorter at the back end than at the front, so that the floor slopes down.

Two vertical interior compartment walls 231, 233 divide the bottom of the pack into front interior compartment 213, left and right interior compartments 214L, 214R. The interior compartment walls are approximately half the height of the respective adjoining pack-body walls. Front interior compartment wall 231 is parallel to the pack front wall, attached with sewn thread to the respective side walls and to the floor, thereby forming front interior compartment 213. The right side of front interior compartment has paint cradle floor 253 as a ceiling; the left side is open on top. The front interior compartment wall upper edge is fitted with a hook-sided strip of nylon hook-and-loop fastener 232.

Center interior compartment wall 233 forms left and right interior compartments 214L, 214R behind the front interior compartment wall, each bounded by the floor, back wall, respective side wall, front compartment wall, and center interior compartment wall. The center interior compartment wall is attached with sewn thread to the back wall 212, front interior compartment wall, and floor. The right interior compartment has paint cradle floor 253 as a ceiling. The center interior compartment wall upper edge has two horizontal hook-sided strips of nylon hook-and-loop fastener attached, facing right 235R, and left 235L. A hook-sided strip 221 is sewn to the back wall inside surface, from the center interior compartment wall top edge to the pack left back corner. Right side wall 211R is furnished with access port 219. The port is a horizontal opening, with upper and lower edges removably fastened together with mating strips of nylon hook-and-loop fastener 217. These are sewn with thread into the pack wall near the lower edge behind the front compartment wall, and can be opened and closed from the outside of the pack.

Rectangular interior hatch 237 is constructed similar to left hatch 187L described above. The left edge is sewn horizontally to the left pack wall inside surface, parallel to the center interior compartment wall top edge. The front, back, and right bottom edges of the hatch are attached with sewn thread with loop-sided strips of nylon hook-and-loop fastener 239, that respectively mate to hook-sided strips, including 235L attached with sewn thread to center interior compartment wall upper left edge, 232 on the front interior compartment wall upper edge left of the mid-line, and 221 on the back wall. Left and right rectangular lightweight stiffeners 241L, 241R are attached with sewn thread to the hatch symmetrically on either side of the mid-line. Front and back loop-sided nylon hook-and-loop fastener tabs 222F, 222B are attached with sewn thread to the interior hatch upper surface left side, above the left stiffener. These align and mate respectively with front and back tab anchors 223F, 223B on the left wall inside surface.

Box 227 made of lightweight stiff material, fits snugly into left interior compartment 214L. The box has a rectangular floor 226 adjoined by front, back, left, and right walls 228F, 228B, 228L, 228R. The walls fold up from the floor and are joined to each other at the respective edges with strapping tape 218. Strapping tape is strong flexible tape with adhesive material on one surface, that can hold things together.

Paint cradle 252 is an approximately rectangular container made of flexible material attached with sewn thread, with floor 253, vertical front wall 254, back wall 249, left and right side walls 251L, 251R. Front and back interior dividing walls 255, 257 parallel the front wall. Attached with sewn thread to the cradle side walls and floor, they form three interior compartments. Three boxes 261, 263, 265 made of lightweight stiff material, fit snugly into the three interior paint cradle compartments. Each box is constructed like box 227 described above. Nylon hook-and-loop fastener loop-sided strip 236 on bottom outside edge of left wall of 251L mates with hook-sided strip 235R on the center interior compartment wall upper edge right side. Loop-sided strip 238 is attached with sewn thread to the underside of the paint cradle floor, mating with hook-sided strip 232 on the front compartment wall 231 right side upper edge.

Paint cradle grommets 259 and pack wall grommets 225 on the respective upper edges, are attached with blind rivets 183 to holes 185 on the inside of the frame 175, and mid-tube 180 right side. Like the hatch grommet illustrated in FIG. 28, each pack wall grommet is attached to a corresponding hole in the frame. The paint cradle left wall has a plurality of grommets that mate with holes in the mid-tube 180 right side. The paint cradle right, front and back walls have a plurality of grommets that are paired with grommets in the respective pack walls. For instance, the paint cradle right wall 251R back grommet 259 is paired with the pack-body right wall 211R back grommet, the corresponding pair of grommets attached with a single blind rivet to the back hole of right side tube 177R. And so on around the remaining paint cradle walls, each grommet sequentially paired with a corresponding pack-body grommet, and each pair riveted to a corresponding hole.

Ordinary paint supplies are illustrated in FIG. 8. Paint tubes 229 shaped like flattened cylenders, brush(es) 243 with bristles and thin elongated handles 798, pallet knife 245 with a blade and thin handle 799, and cloth rags 244 are well known to users, and are held in the pack as described below. Jar(s) 268 for liquid paint solvents, and pallet 267 are modified for the invention as described below. Additional supplies can be included according to user preference.

The Pallet: Pallet 267 in FIG. 1 is illustrated in perspective view in FIG. 9. The pallet is removably and adjustably attached to left and right legs 31L, 31R and pack frame 175 with an adjustable harness arrangement, supported from below by support tube 269. The pallet is an ordinary artists pallet: a flat sheet of stiff material with a cut out 784 near one edge, and a hole 787 behind the cut out. The pallet is fitted with front slot 278F behind the front edge mid-line, and left and right slots 278L, 278R symmetrically situated left and right near the back edge. The front slot is traversed from beneath by button 275F, with parallel slots 276 fastened to strap 271 by sewn loop 277. The strap sequentially traverses support tube upper wall hole 279, the tube front end, cord lock 281, ending with stop knot 283.

Wingless snap hook 301 is constructed of stiff material, consisting of hook 712 closed by snapping tongue 710. The two are joined at rounded crotch 302, the rounded area inside the crotch edge opening into the area between the hook and the tongue. The wingless snap hook is pivotally held in place against the support tube open back end by cord 305 looped through crotch 302. The two ends of the cord traverse tube wall hole 307, terminating in stop knot 309 against the tube wall.

Left and right slots 278L, 278R at the rear of the pallet are similarly traversed by respective buttons 275L, 275R, fastened respectively to left strap 287 and right strap 289 by sewn loops through the button slots. The left strap is attached at the back end with sewn loop 294 to ring 292. The right strap sequentially traverses glove hook 291, cord lock 293, and terminates with stop knot 295.

Solvent Jar: Jar 268 illustrated in FIG. 1 is best seen in perspective view in FIG. 13. The jar is made of non-shattering plastic material, consisting of a molded cylindrical container with a floor, open at the top end. Spiral ridged threads 790 are molded on the open end, that mate with molded threads 792 on the screw-top lid 458. The molded lid consists of a round roof with walls protruding down, fitting onto the jar open end. The respective threads are placed adjacent and rotated clockwise to fasten the lid to the jar, and counterclockwise to unfasten. The lid secures solvent within the jar. Two jars can fit into front interior compartment 213, as seen in FIG. 8. The jar is attached to nylon strap 461 with strapping tape 459 near the top, and the strap is attached with sewn loop 463 to standard snap hook 465.

Figure 9:
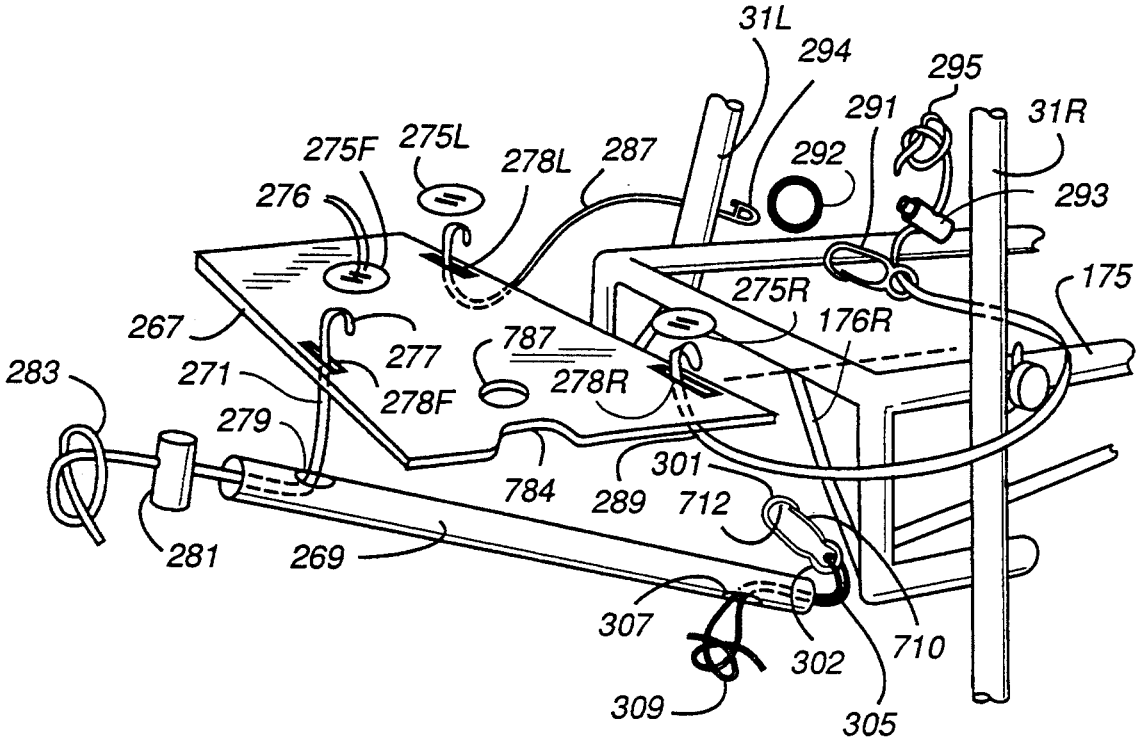
FIG. 9 is a perspective view of the pallet attached to the easel system.

Constructed of rigid material, standard snap hook 465 consists of the wing 724, and the snap hook portion, similar to 301 in FIG. 9 described above, with hook 727 connected to snapping tongue 729 at crotch 728, the snapping tongue end resting against the tip of the hook. The flat rectangular wing is open in the center, with two wide and two narrow sides. Inserting wing-segment 726 is a thinner segment in the center of one wide side, housed in rounded portion of crotch 728, pivotally connected to the hook. Strap 461 is attached by sewn loop 463 to the wing side opposite the inserting segment. The hook is operated by hand, by pressing an object past the snapping tongue into the area between the hook and tongue, which snaps shut. The tongue is pressed open with the fingers to release the hook from the objects locked within. All standard snap hooks in this patent application are similar in structure and operation to standard snap hook 465.

Figure 10:
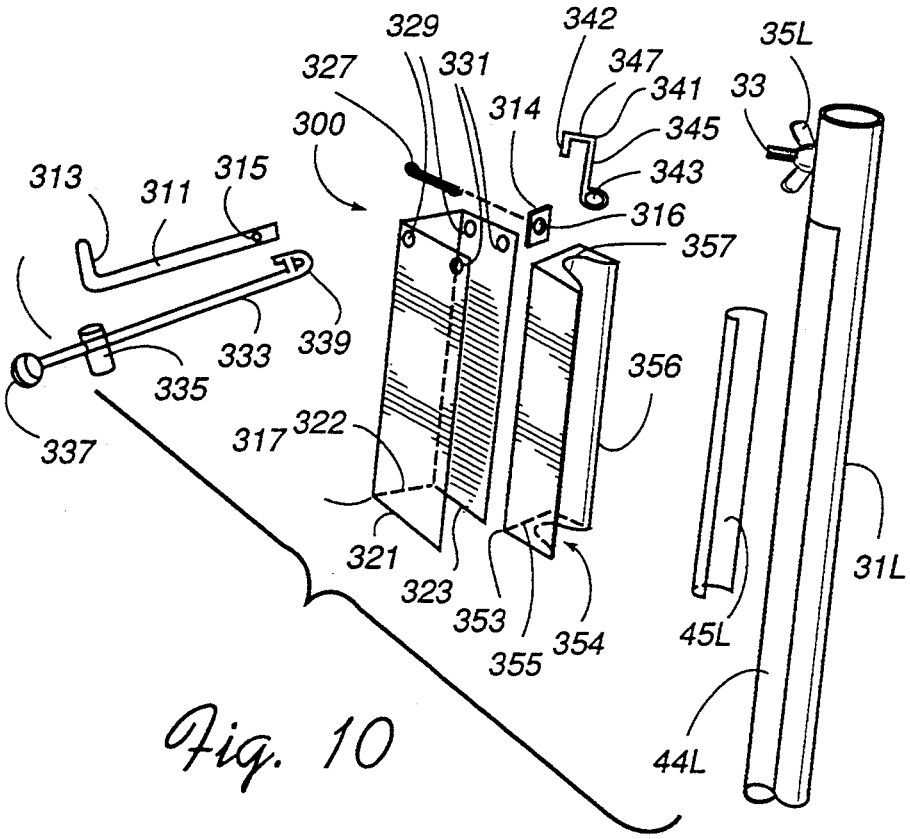
FIG. 10 is a perspective view of the pivoting canvas support.

Canvas Supports: It can be seen in FIG. 1 that the canvas lower edge rests on pivoting canvas support 300, mounted on left leg 31L, illustrated in perspective view in FIG. 10 and FIG. 11. The right leg is a mirror image configuration. Turning to FIG. 10, please note that the outside of left leg 31L is towards the left. As seen most clearly in FIG. 10, handle 317 is a vertical channel made of stiff material, consisting of three flat rectangular walls. Outside wall 322 faces away from the leg toward the outside, connected perpendicular to front wall 321, facing front; and back wall 323, facing back. The three equal walls form a channel open towards the inside, such that insert 353 fits snugly inside the channel. Made of stiff material, the insert has rectangular front wall 354, outside wall 355, and back wall 356 that mate respectively with the channel interior walls; insert inside wall 357 is concave.

The top and bottom ends of the channel and insert are open, such that the convex leg rests inside the channel against the concave insert, which is covered with vertical hook strip of nylon hook-and-loop fastener 45L, attached with adhesive. The outside edge of the leg is covered with mating loop-strip 44L, similarly attached with adhesive.

The insert is shorter than the handle. Horizontal rigid support bar 311 traverses paired holes 329 in the handle above the insert top end, adjoining the outside wall. The support bar protrudes from the handle front and back walls. The portion protruding front curves upward 313 at the end. The support bar is attached by cotter pin 327, which traverses support bar hole 315 in the protruding back end, fastened to hole 316 in flange 314, which is a ridge welded to the back wall. The cotter pin is a U-shaped strand of bendable stiff material, with one leg of the U bent so that it lies side-by-side against the other leg. The legs are together inserted through a hole(s), and fastened by bending the protruding legs apart.

Figure 4:
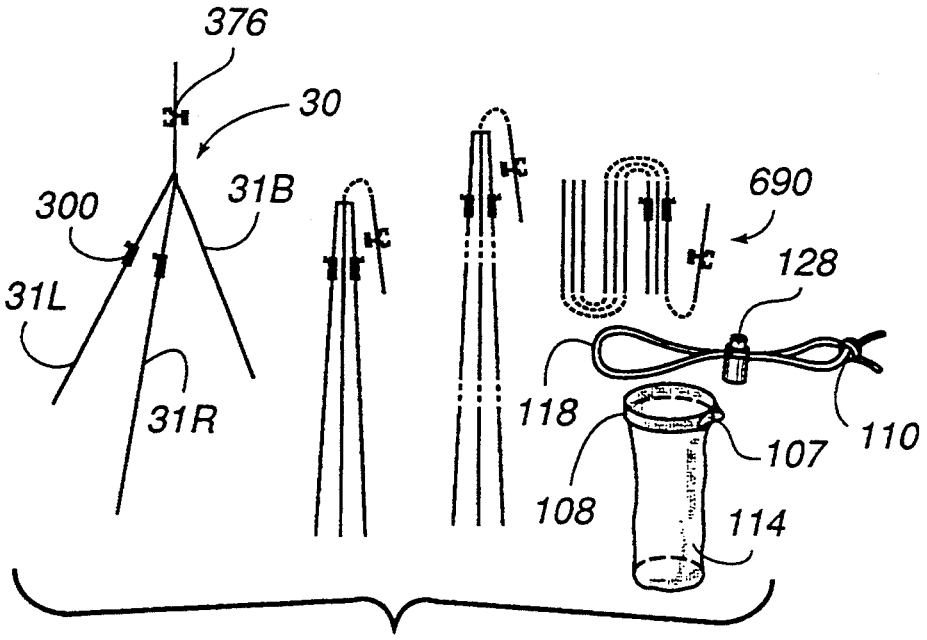
FIG. 4 is a front view showing how the tripod is folded and stored in a stuffsack.

The portion of the support bar inside the handle rests against the leg above the insert. Resilient cord 333 traverses paired holes 331 of handle front wall 321 and back wall 323 inside upper corners, parallel to the support bar. The cord protrudes from the handle front and back walls. The portion protruding front traverses cord lock 335, ending with stop knot 337. The portion protruding back is attached to loop 343 of inside hook 341, with sewn loop 339. The cord goes around the inside surface of the leg, holding the leg within the channel. The pivoting canvas supports remain on the legs at all times, and are transported on the legs in stuffsack 114 as shown in FIG. 4.

Inside hook 341 has three straight sides connected at right angles, constructed of rigid material. Back side 345 has loop 343 at the bottom facing back. The back side connects with middle side 347, connecting in turn with front side 342.

Rectangular artist canvas 39, ordinary and well-known to users, seen in FIG. 1 and FIG. 14, is best illustrated in FIG. 15. The canvas consists of stretched cloth 795 attached to a rectangular frame composed of stretcher bars, with tacks 796 (or staples), as illustrated in FIG. 15. FIG. 20 best illustrates in perspective view the four elongated stretcher bars, including top 572, two side stretcher bars 570, and bottom stretcher bar 797. The stretcher bar courners are joined with 45 degree mating ends, fastened with tongue-and -groove joints, glue, screws, or nails. The stretcher bars are held by the present invention for painting and for transport, as described below.

Figure 11:
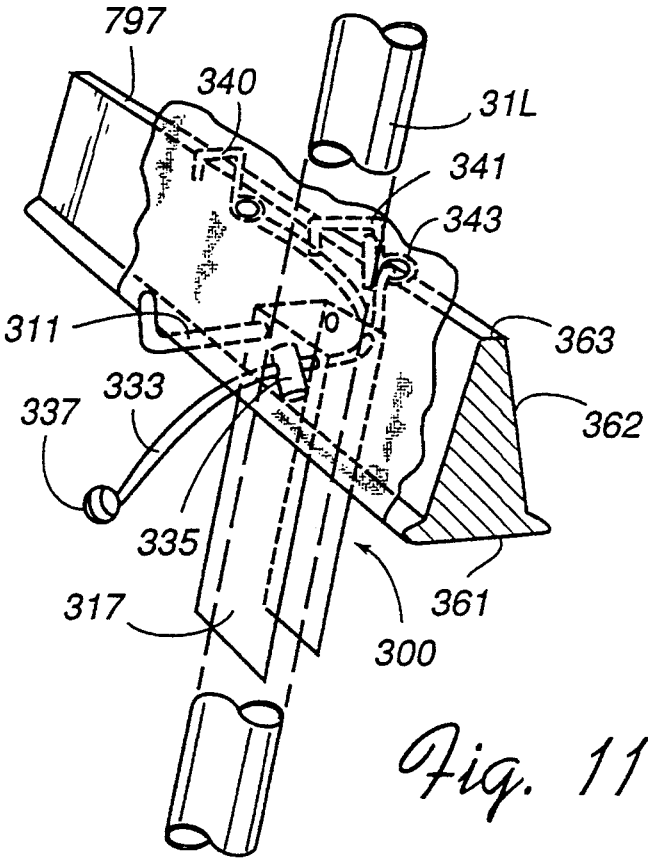
FIG. 11 is a perspective view of the pivoting canvas support inside hook in operation.

FIG. 11 best illustrates in perspective view the lower stretcher bar held for painting on the support bar. The stretcher bar cross-section is basically trapezoidal, with outside edge 361 wider than inside edge 363, the two edges connected to symmetrical walls 362. The sides of the inside hook fit snugly around the three sides of stretcher bar inside edge 363 with loop 343 facing back as the stretcher bar rests on support bar 311.

Figure 12:
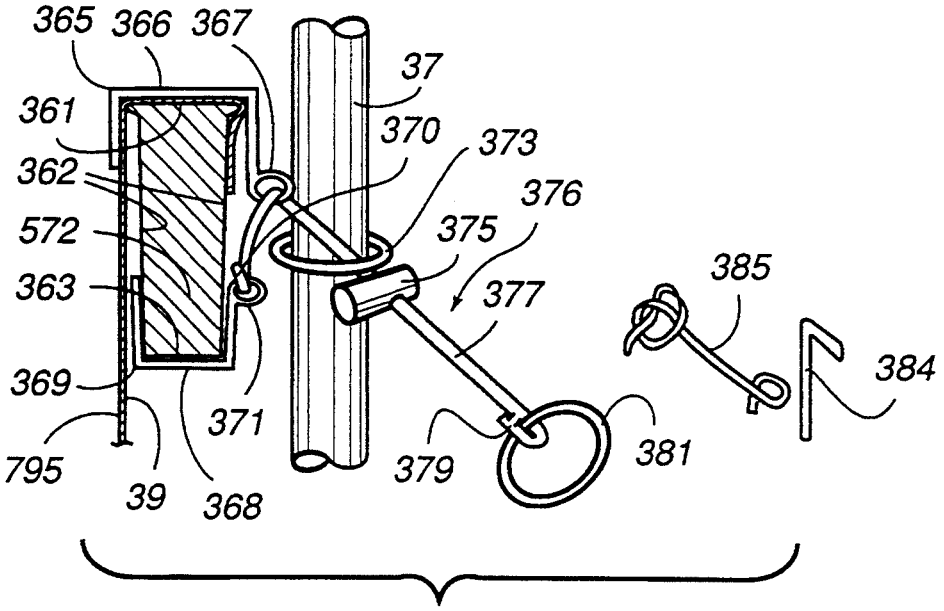
FIG. 12 is a perspective view of the canvas support rig.

Canvas support rig 376 in FIG. 1, is illustrated in perspective view in FIG. 12. The stretcher bar is held to the mast by the rig, grasped simultaneously between support rig inside hook 369 below, and outside hook 365 above. The outside hook differs from the inside hook only in that outside hook middle side 366 is wider, to fit around the wider stretcher bar outside edge 361. There is a gap between the two hooks on stretcher bar wall 362, thereby separating the loops of the two mounted hooks by a distance. Canvas support rig cord 377 is attached with sewn loop 370 to inside hook loop 371, sequentially traversing outside hook loop 367, ring 373 around mast 37, cord lock 375, and attaches with sewn loop 379 to ring 381. The canvas support rig remains on the mast at all times, and is transported in stuffsack 114 on the legs as shown in FIG. 4.

Stakes and cords 384 and 385 in FIG. 12; 36 and 38 in FIG. 1; 589 and 588, and 599 and 598 in FIG. 20; are lightweight tent stakes and cord connected by tied knots. A stake is a stiff elongated object, with a pointed end for sticking into a surface, and an angled end so that a tied cord will not slip off. They are stored in stuffsack 793, shown in FIG. 8.

The Canvas Stabilizer Rig: The canvas stabilizer rig 450 is illustrated in perspective view from the rear in FIG. 14 and is also shown (right side only) in FIG. 19. The rig consists of a cord with left and right sides 451L, 451R, knotted at the midpoint to the loop 448 of glove hook 449, which is clipped to back leg middle segment anchor 81B, also illustrated in FIG. 6. The left side of the cord (on the right side in this rear-view illustration) sequentially traverses the loop of glove hook 453, which is clipped to back tube outside anchor 161L, then traverses the loop of glove hook 455, cord lock 457, and ends with stop knot 456. Stabilizer rig glove hook 455 is clipped to holdfast glove hook 395. The holdfast 386 is illustrated in detail in FIG. 15 described below, and is here shown detached from its home anchor 161L, with the upper end attached to the canvas upper stretcher bar 572 with inside hook 391 and outside hook 389. These are identical to inside and outside hooks 365 and 369 in FIG. 12 described above. The left side of the canvas stabilizer rig is a mirror image of the right. The rig is stored in stuffsack 793, shown in FIG. 8.

External Pack Fittings: External pack fittings are illustrated in perspective view from the rear in FIG. 15, with the right side appearing on the left in the illustration. Left holdfast 386 is comprised of the following parts: Left holdfast cord 387 top end is attached with sewn loop 393 to the loop of inside hook 391. The cord sequentially traverses the loop of outside hook 389, the loop of glove hook 395, cord lock 397, ending with stop knot 399. The glove hook snaps to the outside left anchor 161L. The right holdfast cord configuration is a mirror image of the left.

Handle 401 is a strap with right and left sewn loop ends 403R, 403L attached to right and left inside anchors 163R, 163L respectively.

The right shoulder strap 420 consists of top segment 415 and bottom segment 425. The top segment upper end is attached with sewn loop 417 to standard snap hook 419, snapped to back tube right inside anchor 163R, next to the handle. The bottom end is connected with sewn loop 421 to standard ladder lock 423.

Turning to FIG. 24, a rear perspective view of standard ladder lock 423 in FIG. 15 is illustrated. The standard ladder lock consists of stiff material, including of two parallel vertical side bars 711 traversed perpendicular by top horizontal cross bar 713, second cross bar 719, triangular middle cross bar 716, and slanted bottom cross bar 718, attached to down-facing smooth flat tab 720. Friction ridges are molded on the middle cross bar front surface 715, and the bottom cross bar back surface 717. Fixed strap 415 is fastened to the top bar with sewn loop 421. The shoulder strap bottom segment 425 adjustably loops through the ladder lock from below, routed around the middle cross bar from behind, and the free end 722 exits downward between the tab and the strap. In addition to the friction ridges, the contiguous strap segments create friction beneath the tab, which holds the strap in position. The shoulder strap is tightened by pulling the free end down, and loosened by pushing the tab up with the thumb, allowing the strap to slide back through the ladder lock.

Returning to FIG. 15, bottom segment 425 bottom end is connected with sewn loop 426 to standard snap hook 429, clipped to top grommet 430T of grommeted strap 431. The grommeted strap has top and bottom grommets. Bottom grommet 430B is traversed by clevis pin 167R on right side tube 177R, pivotally connecting the shoulder strap to the clevis pin. The left shoulder strap is a mirror image of the right.

Stuffsack 114 is an ordinary stuffsack, as best illustrated in FIG. 4, consisting of a tubular wall of flexible material sewn closed at one end. The open end has sewn channel 108 around the top edge, with an opening 107. Adjustable closure cord 118 rests within the channel protruding out the opening. The ends of the cord traverse cord lock 128, ending in stop knot 110. Illustrated in FIG. 8, stuffsack 793 is smaller and narrower, but is constructed identical to stuffsack 114.

Returning to FIG. 15, left stuffsack strap 405 is attached to left back tube outside anchor 161L with sewn loop 407, such that the strap protrudes above and below this sewn loop. Strap upper segment 409 is attached with sewn loop 411 to standard ladder lock 413. The right stuffsack strap is a mirror image of the left. Standard ladder lock 413 is similar in structure and operation to standard ladder lock 423 described above.

Figure 17:
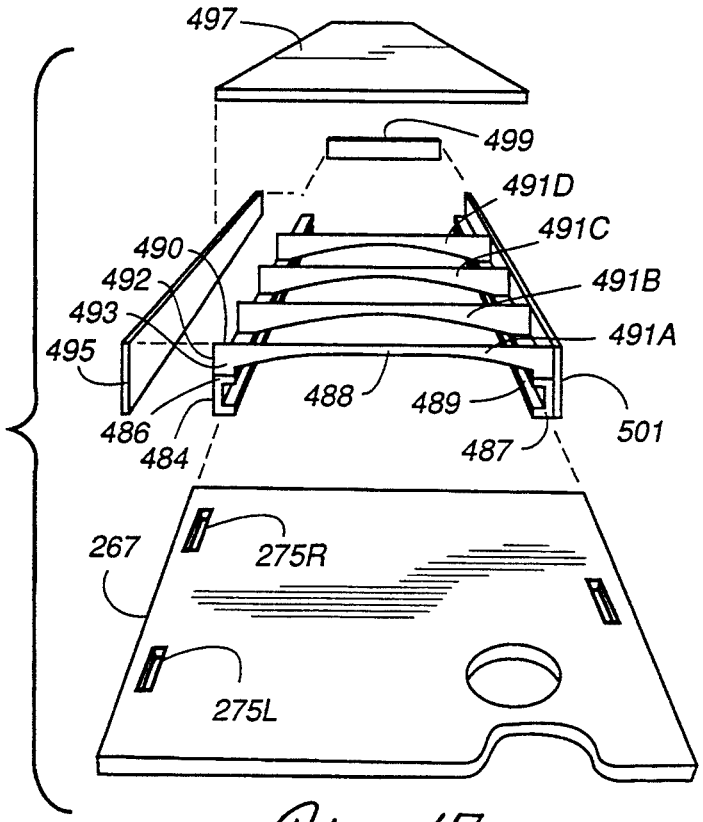
FIG. 17 is a perspective view of the wet-pallet housing.

Wet Pallet Housing: Turning to FIG. 17, wet pallet housing 501 is constructed of lightweight stiff material. The housing has left and right sides, each side consisting of grooved extrusion 487, with groove 489 on the respective inside surfaces, such that the pallet 267 can slide into the grooves. The grooved extrusion serves as foundation for a series of parallel arches 491A, 491B, 491C, 491D. Each arch has a flat horizontal top edge 490, parallel vertical side edges 492, and feet 493 welded to the extrusion upper edge 486 on each side. The arched bottom edge 488 curves upward to the midpoint from the foot on each side. Symmetrical side walls 495 extend along the sides, equal to the height of the grooved extrusion plus the arches. The side wall is welded to arch outside edge 492 and extrusion outside edge 484. Back wall 499 is welded to the extrusion and side wall back edges, equal in height and width to the side wall back edges. Roof 497 is welded to the upper edges of the arches, side walls and back wall, extending in width from left side wall outer edge to right side wall, and in length from front arch 491A to back wall 499. The arches keep the roof 497 supported well above the paint on the pallet upper surface when the pallet is slid into the grooves.

Figure 18:
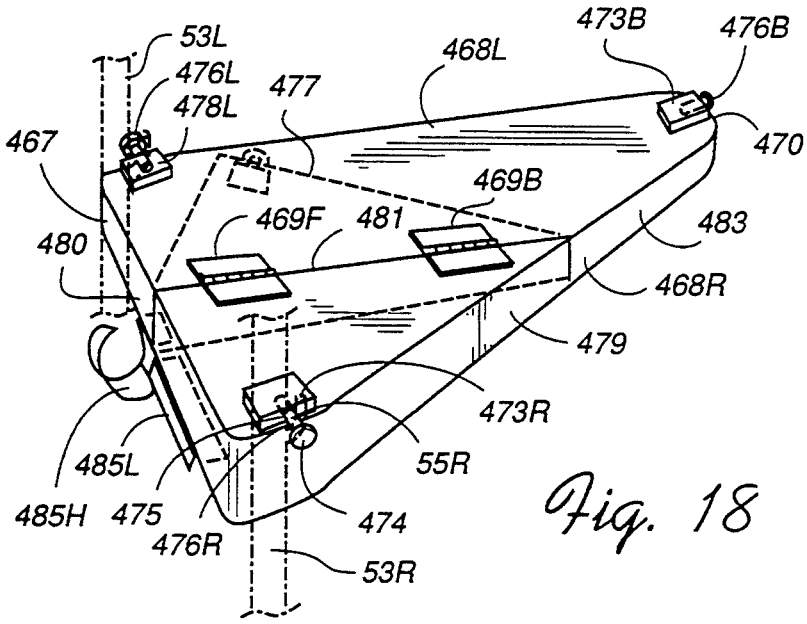
FIG. 18 is a perspective view of the auxiliary triangular insert.

Auxiliary Triangular Insert: Auxiliary triangular insert 467 is illustrated in perspective view in FIG. 18, and also in FIG. 19. The insert consists of a rigid sheet with front edge 480, and equal right and left sides 468L, 468R. Back corner 470 is broad and rounded, to provide a support surface for the back leg. The insert is divided into left and right sections 479, 483, pivotally connected by front and back hinges 469F, 469B along line of division 481, welded to the respective surfaces. The line runs parallel to the left side from the front edge midpoint. The right section pivots 180 degrees from the flat open position in the illustration, to closed position 477, lying on top of the left section. Left, right and back housings 473L, 473R, 473B are welded to the surface near the respective corners. Right housing 473R is a rectangular solid with the small end of right clevis pin 476R glued into hole 475, with disk-shaped head 474 facing right, protruding over the edge. The left pin and housing are a mirror image of the right. The back clevis pin 476B protrudes straight back. Loop surface strip of nylon hook-and-loop fastener 485L is attached to the right side front underside, mating with hook-sided strip 485H protruding from the left front underside. The strips are attached to the insert lower surfaces with glue.

Wind Rigs: FIG. 20 is a rear perspective view that includes the transverse, top, and side wind rigs mounted on stretcher bars. The windrig inside and outside hooks are identical to those described above. Side wind rig 590 is shown attached to side stretcher bar 570. Side wind rig cord 594 is attached to the loop of outside hook 591 with sewn loop 593, then traverses the loop of inside hook 592, cord lock 595, and is attached to ring 597 with sewn loop 596. Cord 598 is tied to the ring, and to stake 599.

Top wind rig 580 is shown attached to top stretcher bar 572. Top wind rig cord 584 is attached to the loop of inside hook 582 with sewn loop 583, then traverses the loop of outside hook 581, cord lock 585, and is attached to ring 587 with sewn loop 586. Cord 588 is tied to the ring, and to stake 589.

Transverse wind rig 579 consists of cord 575 is attached to first outside hook 573 with sewn loop 574, and traverses the loop of second outside hook 578, cord lock 576, ending with stop knot 577.

Operation Of The Invention

The easel system and separate components will perform in the landscape, classroom and studio. The current field-tested prototype weighs only 4.5 pounds (excluding the auxiliary triangular insert and the wet pallet housing), and could be further lightened with alternative materials. Due to the light weight and backpack design, the complete system is comfortably transported. Set-up in only a few minutes, the system is remarkably sturdy. Securely held paint supplies are all accessible from the front, leaving the user's hands completely free while painting. In calm air, the canvas can be raised and lowered very rapidly. The upper corners of a canvas can be braced against the easel system. Wind rigs, stakes, and cords secure the entire system in a stiff breeze.

The Pack: Description of the operation of the easel system will begin with the easel system packed up as a backpack, as illustrated in FIG. 15 and FIG. 16, which show perspective and side views. The pack rests vertically on the ground on down tubes 173L, 173R and front tube 171. The pack rests sturdily in the upright position because the joined down tubes and front tube present a flat featureless surface to the ground, and because acute angle 164 between down tubes and side tubes in FIG. 16 distributes the weight toward the center, resulting in a stable configuration.

Paint supplies, stakes, cords and rigs are stored inside the interior compartments of the pack, illustrated in FIG. 8. Front interior compartment 213 holds solvent jars 268, best illustrated in FIG. 13, lying end to end in the compartment with lids 458 fastened. Paint tubes 229 are stored in paint cradle 252 boxes 261, 263, 265, protected by palate 267 lying on top during transport, beneath fastened by hatches 189, 187L, 187R. Additional paint tubes are stored in left interior compartment 214L box 227, protected by interior hatch stiffeners 241L, 241R. Brushes 243, pallet knives 245, rags 244 and support tube 269 rest atop the closed interior hatch, protected from below by interior hatch stiffeners 241L, 241R, from above by the palate, and on the sides by paint cradle left wall 251L, and left side tube 177L.

Stuffsack 793 holds rigs, stakes and cords, and is stored in right interior compartment 214R.

As illustrated in FIG. 4, and best in FIG. 15, stuffsack 114 holds the folded legs and mast 690. The stuffsack is securely attached in a horizontal position snug against the back tube, held by left and right straps 405 that encircle the stuffsack, attached to outside anchors 161L, 161R. The straps are adjusted tight with standard ladder lock 413, as described above.

As illustrated in FIG. 16 (which shows only the right side) canvas 39 is mounted to the back of the pack seated securely on down tubes 173R against backstops 174R, pulled snug against stuffsack 114 by holdfast 386. As illustrated in FIG. 15, the canvas side stretcher bars 570 rest against the folded legs and mast, to protect the canvas cloth 795 attached to the stretcher bars facing back. For wide canvas, the leg extensions can be adjusted for transport protruding out from the legs, as will be described below.

The canvas top stretcher bar 572 is anchored between clamping jaws of inside and outside hooks 391, 389 of holdfast cord 387, similar to FIG. 14, and a similar configuration is illustrated in greater detail in FIG. 12. Returning to FIG. 15, the holdfast cord is attached to the back tube outside anchors with glove hooks 395, the end pulled snug by hand with cord locks 397 slid against the glove hooks. With the holdfast cords locked snugly, the whole configuration is secure, even for hiking over rough terrain. The backstops do not mar the surface of the painting due to obtuse angle 166 between the respective down tubes and backstops illustrated in FIG. 16, angling the backstops away from the canvas surface but keeping the canvas securely seated on the down tubes.

The pack can be held by handle 401, or transported with the adjustable shoulder straps 420. It is important to know how to shoulder the pack smoothly, especially with a large canvas mounted on the back. To shoulder the pack smoothly, a right handed user stands facing the front of the pack, with the right side of the pack on the user's right. The pack is lifted by the handle 401 with the left hand. The right arm is crossed under the left and inserted into the left shoulder strap. The pack is brought around the shoulder and rested against the user's back, and the left arm is inserted directly into the remaining shoulder strap. For a left handed user, the mirror image of the above operations apply. The straps are loosened by operating the standard ladder locks 423 as described above. The shoulder straps can be detached from the pack with respective snap hooks 419, 429 if desired.

With straps securely adjusted, users can walk, stroll, hike, or even bicycle with the pack. Referring to FIG. 8, a few hiking supplies can be stored in right interior compartment 214R, and retrieved through access port 219 by parting fastening strips 217 without unpacking the pack. On reaching a suitable location, the user loosens the shoulder straps, slides the left arm out, carefully pivots the pack around the right shoulder, until the left hand can grasp the handle. The right arm then slides out, and the pack is placed upright on the ground.

Setting Up The System: Returning to FIG. 15, canvas 39 is removed from the pack by first sliding holdfast cord locks 397 to free end of holdfast cords 387 respectively as described above, then disengaging inside and outside hooks 391, 389 from upper stretcher bar 572, and lifting the canvas out. To prevent the hooks from tangling, the holdfast cord end is pulled out, thereby positioning the hooks against the back tube anchors 161L, 161R, and the cord locks are slid against the anchors. With the canvas safely out of the way, stuffsack straps 405 are loosened with standard ladder locks 413 as described above, and stuffsack 114 is slid out.

FIG. 4 is a front view showing how the tripod is set up. Proceeding from right to left in the illustration, the stuffsack is opened by sliding cord lock 128 to the knotted end of cord 118, and opening the top end. The folded legs and mast 690 are removed from the stuffsack, which is set aside. Referring also to both FIG. 2 and FIG. 5, the joined legs are grasped just below threaded rod 33, with back leg bend 120 facing back. Then, the middle segments and lower segments are allowed to freely unfold with gentle shaking. They are automatically snapped into place by respective shock cords 43, and 157 for the back leg, with respective connecting tubes 51 and 89 fitting into the upper and middle segment bottom ends for each leg, until the legs dangle straight down. The legs 31L, 31R, 31B are stood on the ground, wingnuts 35L, 35R are loosened as described above, and the legs are spread back leg backward, left and right legs to the sides.

Referring to FIG. 2 and FIG. 3, the respective leg extensions 115 of the three legs are adjusted. The lower leg segment is held inonehand, and the other hand pivots clamp level 111 upward, thereby disengaging the clamp lever walls 112L, 112R from the clamp mounds 109, allowing the clamp walls 102 and clamping slots 101 to expand, such that the leg extension slides within the lower segment for each leg. The user extends each leg extension by hand to a convenient height for painting, taking care not to go beyond marker line 96, which indicates the point where the leg extension would become unstable in the housing. Irregularities in the surface are taken into consideration to ensure the easel system is level. Each leg extension is locked into position by pivoting the clamp lever downward, thereby squeezing and locking the leg extension.

Next, the middle and lower segments of each leg are turned into position by hand. Referring now to FIG. 6, left and right middle segments 53L, 53R are turned into alignment with the respective support arms 55L, 55R facing directly back, and back leg middle segment 53B is aligned with support arm 55B facing right. Referring also to FIG. 2, while one hand holds the middle segment in position, the other hand turns lower segment anchor 121 into alignment facing into the center of the tripod, for each leg.

Crossbracing cord 71R is disengaged from the storage configuration, and allowed to dangle. Referring now to FIG. 2, the storage configuration is as follows: left and right facing ends 63, 64 are put into support arm notch 60 and pulled down, thereby seating the bungee-cord hooks 70 against the notch protruding out. The cords are pulled down the leg past tab 75, and loop-sided strip 77 is pulled away from hook sided strip 79, thereby opening the tab. The cords are sandwiched between mating loop strip 77 and hook strip 79 which are press-fastened together with the cords between them. The cords are released from this configuration simply by pulling the bungee-cord hooks away from the notch, thereby pulling the cords through the tab. The same procedures apply for the left and back legs.

With the extended legs spread sufficiently apart, the pack is ready to be seated in the tripod as in FIG. 1, referring also to FIG. 8, FIG. 6 and FIG. 15. First, the pack is held vertically by the handle 401 with the left hand, as in FIG. 15. The dangling shoulder straps 420 are pushed around to the back and gathered into the right hand. Making sure that the clevis pins 167L, 167R, 167B are extended fully out, the pack is then pulled into the horizontal position as in FIG. 1 and FIG. 8, supported by the right hand from the bottom with the handle facing back. The left hand lets go the handle, and reaches around the left leg to guide the pack back end between the front legs. Steadied by the left hand, back tube clevis pin 167B is seated in back leg support arm 55B, as illustrated in FIG. 6. Right and left clevis pins 167R, 167L are seated in respective support arms 55R, 55L.

The crossbracing cords are fastened respectively to the leg bottom ends, referring now to FIG. 1, and FIG. 2. First, right crossbracing cord 71R is pulled into the center of the tripod by sliding cord lock 69 against bead 73 with one hand, as the other hand pulls the cord inside. The same procedure for each leg. The bungee-cord hooks 70 of each crossbracing cord are then fastened sequentially to respective lower segment anchors 121 as follows: Referring also to FIG. 6, right leg left-facing cord end 63 is hooked to left leg extension anchor 121, by putting the point of the hook through the opening between the anchor and the leg. The left leg right-facing cord end 62 hooked to the right leg extension anchor, the two cords crossing as illustrated in FIG. 1.

Moving to the right side of the easel, right leg right-facing end 64 and back leg left-facing end 65 are similarly attached, crossing in the middle. The procedure is the same with cords 61, 66 on the left side. Once all six hooks are in place, the crossbracing cords are adjusted by pulling the outside loops 72 outward, snug but not tight, and locking them in by sliding the respective cord locks against the legs. Each pair of legs is thereby cross-braced against the pack frame, which itself is a rigid brace between the legs. Readjusting the legs and cords several times ensures a solid configuration.

The adjustable crossbracing cords can accommodate any configuration of leg lengths. Referring to FIG. 1 and FIG. 2, if it is necessary to re-adjust a leg lower, the leg extension is re-positioned further into the leg tube as described above, and then the attached crossbracing cords are locked in snug with the cord locks. To further extend a leg, the attached crossbracing cords first must be loosened by sliding their respective cord locks away from the legs.

Users may wish to set up the easel system in a very low position, for sitting on the ground. In this case, once the legs are standing but before the crossbracing cords are attached, the respective lower segments 99L, 99R, 99B are pulled out from the respective middle segment housings, and folded back along the ground out of the way. With the three middle segment bottom ends rest on the ground, the tripod stands at two-thirds height. The pack is seated in the tripod as above, and the cross-bracing cord ends are connected to respective middle segment anchors 81L, 81R, 81B shown in FIG. 6 and FIG. 2, in a crossbraced configuration similar to that described above.

Referring to FIG. 5 and FIG. 1, mast 37 is raised vertical by hand, and automatically snaps into position by shock cord 127, inserting connecting tube 125 into the back leg top end. The backstay 140 is then released from the storage configuration, which is as follows: glove hook 143 is clipped to anchor 151, and backstay cord 141 is pulled up along the mast past tab 159, which is pulled open. The cord is press-fastened between the mating loop and hook strips of the tab, similar to the crossbracing cord storage configuration described above. The backstay cord is removed from the storage configuration simply by un-clipping the glove hook from the anchor, and pulling it downward, thereby pulling the cord through the tab. The glove hook is snapped to ring 139 protruding from the mast top end, and the backstay cord is adjusted snug by pulling the top end tight and sliding cord lock 145 against glove hook 143. The mast is further secured by tightening wingnuts 35L and 35R.

Referring to FIG. 2 and FIG. 5, if it is necessary to move the erected easel system after the initial set-up, the user should first tighten the shock cords of each leg, so that the leg segments cannot pull away from each other. For the left and right legs, the user pulls shock cord 43 top end away from hole 48, and locks the cord in this position by sliding cord lock 47 against the leg. For the back leg the similar procedure with cord 157, hole 155, and cord lock 153. Similarly for the mast, when backstay 140 is adjusted snugly, a length of shock cord 127 is pulled out of the mast top end, thereby tightening the mast shock cord.

Mounting The Canvas: The canvas is mounted as illustrated in FIG. 1. Referring also to FIG. 10 and FIG. 11, left and right pivoting canvas supports 300 are positioned at an appropriate height on the respective legs, at least 8 inches above the pack frame. The pivoting canvas supports are stored with the inside hooks locked snug against the handle. To ensure that they have not slipped, the front end of resilient cord 333 is pulled snug and cord lock 335 is slid against the handle 317. Then the pivoting support is rapidly positioned, by pivoting the bottom end of handle 317 outward from the leg, thereby detaching insert nylon hook-and-loop fastener strip 45L from leg strip 44L. In this detached position, support bar 311 is still held against leg strip 44L by resilient cord 333, and the smooth support bar surface can easily slide along smooth loop-strip 44L due to the lack of friction. The user can easily slide the pivoting canvas supports on each leg up or down along the legs together with both hands, even with a canvas seated on the supports. Once a satisfactory position is achieved, the handle is re-attached by pivoting it down against the leg, thereby engaging the nylon hook-and-loop fastener surfaces, locking the handle into place. The procedure takes only one or two seconds.

Referring to FIG. 1, the canvas lower stretcher bar 797 is seated on the support bars. The top edge is secured to mast 37 with canvas support rig 376 best illustrated in FIG. 12. First, cord 377 is slackened with cord lock 375. Ring 373 is slide along the mast to the canvas upper edge. Outside hook 365 is fitted snugly over stretcher bar outside edge 361, and over the stretched cloth 795. The thin outside hook obscures only a small portion of the cloth in front. Then inside hook 369 is fitted around stretcher bar inside edge 363. The back end of cord 377 is pulled snug, and locked in by sliding the cord lock 375 against the ring and mast, thereby securing the stretcher bar between the clamping jaws of the inside and outside hooks. The entire configuration is snug against the mast but it slides easily, so that the canvas can be rapidly re-positioned merely by manipulating the pivoting canvas supports as described above.

To disengage the canvas support rig, the reverse of the above operations, slackening the cord, removing the hooks, and again locking the hooks snug against the mast for storage with the cord lock, to prevent tangling.

Setting Up For Wind: The entire easel system can be staked out to the ground if deemed necessary. Referring to FIG. 8, stuffsack 793 is removed from right interior compartment 214R through access port 219, and opened similar to stuffsack 114 described above. Stakes, cords, canvas stabilizer rig, and wing rigs are removed from the stuffsack as needed. Returning to FIG. 1, and FIG. 2, with the shock cords tightened up inside the legs as described above, cords 38 are tied between the outside loops 72 of each crossbracing cord 71R, 71L, 71B respectively, and stakes 36 or other fixed objects, thereby pulling the crossbraced legs away from each other. Because the cords can be attached to any appropriate object that gives good leverage, the easel system can be set up in any location with good purchase nearby. Double-staking each leg in two directions creates an especially sturdy configuration.

Means to further secure the canvas in the wind are as follows: First, as illustrated in FIG. 11 and FIG. 10, inside hook 341 is employed to attach the canvas lower stretcher bar to support bar 311, and leg 31L. Cord 333 is slacked by sliding cord lock 335 to the front end. Inside hook 341 is pulled out from the handle 317 and fitted over the stretcher bar inside edge 363, in FIG. 11. The inside hook can be put on the stretcher bar directly, or routed around the leg as in position 340. The front end of the cord is pulled snug and locked into position with the cord lock. The right side is identical. The inside hooks must be re-adjusted if the canvas is moved up or down along the legs. When the inside hooks are disengaged, they are restored to the storage configuration described above.

Second, referring to FIG. 1 and FIG. 12, the canvas support rig 376 can be staked to the ground directly, with cord 385 tied to ring 381, and to stake 384 or to a fixed object.

Third, turning to FIG. 20, the outside hooks 573, 578 of transverse wind rig 579 are fitted over side stretcher bars 570 of the canvas, with cord 575 routed behind mast 37 or front legs 31L, 31R. The free cord end is pulled out, and the cord lock 576 locked against the second outside hook 578.

Fourth, top and side wind rigs 580, 590 can join the stretcher bars directly to the ground or to a fixed object. Top wind rig inside and outside hooks 582, 581 are clamped and locked to top stretcher bar 572, similar to the configuration in FIG. 12 described above. The rig is locked onto the stretcher bar by pulling the cord 584 ring-end out, and sliding cord lock 585 against the outside hook. The rig is staked out with cord 588 tied to ring 587 and to stake 589.

Fifth, side wind rig cord 594 is attached first to the outside hook 591, and then traverse the inside hook 592 loop. This gives leverage for the cord to be pulled outward, toward the side or front. The rig is locked onto side stretcher bar 570 by fitting the inside and outside hooks onto the stretcher bar as above, pulling the cord ring-end out, and sliding cord lock 595 against the outside hook. The rig is staked out with cord 598 tied to ring 597 and to stake 599.

Many wind rigs can be used in combination. They must be re-adjusted if the canvas is moved up or down along the legs. Obviously, it is possible to attach additional cords to various parts of the easel for additional leverage against the wind. If stakes are well placed and cords are well tied, the user can paint in a stiff breeze, especially if the canvas is not overly large.

To detach the respective wind rigs: stakes and cords are detached, the wind rig cords loosened with the cord locks, and the wind rig inside and outside hooks detached from stretcher bars. The wind rigs are readied for storage by sliding the two hooks contiguous, sliding the cord lock against the contiguous hooks.

The Canvas Stabilizer Rig: Illustrated from the rear in FIG. 14 and also in FIG. 19, the canvas stabilizer rig 450 optionally is used to brace the canvas upper corners against the easel system itself, especially a wide canvas. Turning to FIG. 15, holdfast glove hooks 395 are unclipped from anchors 161L, 161R. Returning to FIG. 14, to use the rig, the user attaches central glove hook 449 to back leg anchor 81B. Middle glove hook 453 of left side cord 451L is attached to back tube outside anchor 161L. The holdfasts are attached to the upper stretcher bar outside corners with inside and outside hooks 391, 389, similar to FIG. 12. Stabilizer rig glove hook 455 is attached to holdfast glove hook 395 on each side. The canvas stabilizer rig cords are adjusted snug by pulling the cord ends 456 out, and sliding cord locks 457 against glove hooks 455. The cords are slackened before the canvas is raised higher, and must be re-adjusted after the canvas is moved up or down.

To detach the canvas stabilizer rig, the cord locks are loosened, the glove hooks are all un-clipped. The holdfast inside and outside hooks are detached from stretcher bars, the holdfasts re-clipped to their home anchors 161L, 161R.

Unpacking The Pack: The pack is opened as illustrated in FIG. 8. Hatch tab 205 is unfastened from anchor 207. Front, left and right hatches 189, 187L, 187R are opened by disengaging fastened edges 201 from 199L and 199R, and 197L from 197R. Hatches are folded back over the frame tubes, for example the right hatch 187R in FIG. 1.

Returning to FIG. 8, pallet 267 is removed from its storage position on top of paint cradle 252 and pack frame 175, along with support tube 269. The support tube is attached as best illustrated in FIG. 9, and also FIG. 1. First, wingless clip 301 is clipped to front support bar 176R. Next, the user makes sure that left and right buttons 275L, 275R are secure in respective left and right slots 278L, 278R on the pallet back edge. The pallet back edge is placed on the pack frame top front edge against the legs. Left and right straps 287, 289 are respectively run around the front legs and fastened together, glove hook 291 clipped to ring 292. The right strap end is pulled tight, and the strap is locked in by sliding cord lock 293 against ring 292, thereby seating the pallet snugly. Front button 275F is inserted upward through front slot 278F, and the end of strap 271 is pulled tight and locked by sliding cord lock 281 against the tube, thereby pivoting clip 301 against the support tube as in FIG. 9.

The support tube solidly supports the pallet front edge, sufficient for users to push down with some force while mixing paint. The pallet easily folds down to a vertical position against the left and right legs, simply by sliding right strap cord lock 293 away from ring 292. To hold the pallet freely in the traditional manner, the buttons are removed.

Next, referring to FIG. 8, FIG. 22 and FIG. 1, materials inside the pack are made accessible from the painting position in front of the easel, held securely to the pack. It is important initially to position the canvas at least eight inches above the seated pack frame upper edge as in FIG. 1, so that the paint supplies in the pack can be easily accessed by reaching the hands under the canvas between the front legs. Once the pallet is removed, paint tubes 229 in paint cradle 252 are accessible. Brushes 243 and pallet knives 245 are taken from atop interior hatch 237, and placed handle first in a bundle into open gapped ends 195 of drybrush quivers 193, with the bristles and blade protruding. Also illustrated in FIG. 13, jar(s) 268 is removed from front interior compartment 213 and clipped with standard snap hook 465 to side support rod 179R (and/or 179L) hanging down, with lid 458 unscrewed to access the solvent. Rags 244 can be securely stuffed into the front interior compartment 213.

By placing handles 798 of brushes charged with paint into the individual parallel wetbrush quivers 191, best illustrated in FIG. 22, paint-charged bristles are prevented from contaminating each other through accidental contact. Brushes placed in the jar rest there securely.

Returning to FIG. 8, interior hatch 237 is opened, and nylon hook-and-loop fastener tabs 222F, 222B are press-attached to left wall anchors 223F, 223B respectively. The portion of the hatch on the right of the mid-line hangs down against the left portion, keeping the hatch open, as seen in FIG. 22, making accessible paint tubes 229 and other supplies within.

Wet Pallet Housing: As illustrated in perspective view in FIG. 17, and referring also to FIG. 9, wet pallet housing 501 can be employed in transport to protect wet paint on the pallet upper surface. To transport the pallet in the housing, buttons 275L, 275R are removed from the pallet, which is slid into grooves 489. The housing is placed atop pack frame and paint cradle in the pallet's storage position as illustrated in FIG. 8, with housing back wall 499 seated directly over front tube 171, beneath the fastened hatches. Straps 287, 289 are stored separately in the pack. To use the pallet, the housing is unpacked, the pallet slid out of grooves 489, the pallet buttons replaced, and the housing is set aside.

Packing Up: To pack up the easel system, the above procedures are reversed. First, the interior is re-packed. Referring to FIG. 1 and FIG. 8, the jar(s) 268 is unclipped and stowed with lid screwed on tight, and stored in front interior compartment 213. Left, right and back fastener strips 239 of interior hatch 237 are press-fastened respectively to front compartment wall fastener strip 232, back wall fastener strip 221, and center compartment wall left facing fastener strip 235L. Brushes, pallet knives and rags are replaced on top of the closed interior hatch, the rags cushioning the brushes.

Referring to FIG. 9, the pallet 267 is detached from the pack frame. Front button strap 271 is slackened by sliding cord lock 281 away from support tube 269, and front button 275F is removed from slot 278F. The support bar is un-clipped from the frame and replaced atop the brushes. The pallet left and right straps are similarly slackened with cord lock 293, glove hook 291 is unclipped from ring 292, and the pallet is detached and replaced atop the pack frame and paint cradle. Returning to FIG. 8, the front, left and right hatches 189, 187L, 187R are folded over the top of the pallet, and hatch fastening strips are press-fastened as described above. Finally, right hatch tab 205 is press-fastened to outside back wall anchor 207.

Next, the canvas is removed from the easel and set aside. First, all wind rigs and the canvas support rig are disengaged as described above. Wind rig hooks are locked contiguous as described above. Then, staking cords are untied and stuffed into stuffsack 793, as is the canvas stabilizer rig. Pulled-up stakes and wind rigs are put in last to prevent tangling. The stuffsack is closed by pulling the stuffsack cord end outward, and sliding the cord lock against the staffsack similar to stuffsack 114 in FIG. 4. The stuffsack is placed for transport into right interior compartment 214R through access port 219, as illustrated in FIG. 8.

Disassembling The System: Returning to FIG. 1, FIG. 2 and FIG. 6, crossbracing cords 71L, 71R, 71B are slackened by sliding the respective cord locks against the beads. The bungee-cord hooks 70 are unhooked, and the legs moved slightly apart. The pack is supported from beneath with the right hand, and clevis pins 167L, 167R, 167B are unseated from respective support arms 55L, 55R, 55B with the left hand. The supported pack is removed between the front legs, held by the handle, and stood upright on the ground.

Crossbracing cords and backstay 140 are put into their storage configuration as described above. Leg extensions 115 are re-adjusted in the leg tubes for transport as described above. To transport a wide canvas, the leg extensions are extended out, so that the side stretcher bars 570 are held against the folded legs and mast 690, with reference to FIG. 15.

The tripod is then disassembled. Referring first to both FIG. 2 and FIG. 5, wingnuts 35L, 35R are loosened. Mast 37 is pulled out from the back leg, and folded down. Shock cords 43 and 157 are slackened by sliding cord locks 47 and 153 to the respective cord ends, the elastic shock cords pulling themselves back into the legs. Turning to FIG. 4, proceeding from left to right in the illustration, the upper leg segments and mast are grasped together, and raised up, pivoting the legs together. The leg middle segments are held in a bundle, pulled away from the upper segments, and folded against the middle segments. The double bundle is held together, and the lower segments are pulled away from the middle segments and folded back. The folded legs and mast 690 are inserted into stuffsack 114, which is closed similar to stuffsack 793 described above.

Reassembling The Pack: Referring to FIG. 15, the stuffsack containing the folded legs and mast is inserted into the loops of stuffsack straps 405, and strapped into place against the back tube, with stuffsack straps adjusted snug with standard ladder lock 413 as described above. The canvas is mounted on the pack, snugly anchored by holdfasts 386 as described above, and the easel system is ready for transport.

Independent Use Of The Tripod: The tripod can be assembled and disassembled with auxiliary triangular insert 467 in place of the pack frame as illustrated in FIG. 19. The insert is utilized in the open flat position shown in perspective view in FIG. 18, with the inside edges of the left and right sections 479, 483 adjoined, secured by mating press-fastened hook-and-loop strips 485H, 485L. Like the pack frame, the auxiliary triangular insert is seated horizontally within the tripod. Clevis pins 476L, 476R, 476B are seated in the respective support arms, held snugly in place by the crossbracing cords as above. After slacking the crossbracing cords, removing the insert and detaching the fastener strips, the auxiliary triangular insert can be folded closed 477, and transported with the tripod disassembled as described above, in stuffsack 114 as a self-contained easel.

Mounting A Large Canvas: FIG. 19 shows a perspective view of large canvas 390, mounted with the pivoting canvas supports 300 moved down to lower segments 99L. Referring also to FIG. 10, this is done on each leg by sliding cord lock 335 to cord 333 front end, pulling the cord segment lying between front and back handle walls 321, 323 into a large loop away from the leg. Handle 317 and support bar 311 are pulled out away from leg 31L, detaching nylon hook-and-loop fastener strips 45L and 44L. The pivoting canvas support is slid down the leg, the cord loop hand-guided around crossbracing cord 71R, support arm 55R and tab 75 illustrated in FIG. 2. The pivoting canvas supports 300 are fastened to fastener strip 97R on each lower segment similar to FIG. 10, with elastic cord pulled snug, and locked with the cord lock slid against the handle. A large canvas is best mounted by employing inside hook 341 in FIG. 11 on each side, described above. Referring to FIG. 19, the canvas stabilizer rig 450 is employed as in FIG. 14 (described above, but middle glove hook 453 is not used, because outside anchors 161L 161R are not present. Only the right side appears in FIG. 19).

Independent Use Of The Pack: The pack can be used independently, to transport paint supplies, and as a tabletop paintbox, with pallet 267 and jar 268 resting on the table 601 as seen in perspective view in FIG. 22. The quivers 191, 193 work best if they hang straight down over the table side edge, but can be used on the table top with the quiver bottom folded under 791, the vertical brush handles 798 resting against the table top inside the quivers. The canvas can be mounted for transport as in FIG. 16, but since the folded legs and mast are not present, the canvas cloth will not be protected from mechanical contact.

Variation: The Shell Pack: FIG. 21 illustrates a perspective horizontal view of shell pack 600, a box-like variation of the pack of the preferred embodiment. The floor and walls are composed of stiff, strong material, welded at the joints. The shell pack consists of floor 602, that slants downward from the joint with back wall 604, to the joint with front wall 608, joined at the sides to vertical right and left walls 606R, 606L. These are respectively joined to the front and back walls. The front wall is higher than the back, and side walls are higher in front than in back. The back wall makes an acute angle 609 with the side walls, and the front wall makes an acute angle 610 with the side walls, also seen in side view FIG. 23. The top edges of the four walls are level. A plurality of holes 607 are located on the side wall and front wall upper edges, that mate respectively with grommets of front and side hatches, identical to those of the preferred embodiment (not shown in FIG. 21, but illustrated in FIG. 1 and FIG. 8). Nylon hook-and-loop fastener tab 660 is attached with adhesive to the back wall outside surface, that mates with tab 205 on the right hatch back edge in FIG. 8.

Right cord pocket 670R is a container made of flexible material with front and back walls 671, 673 sewn together along the sides and bottom with thread. The pocket is open at the top, with a grommet 672 near the top edge, similar to the grommets illustrated in FIG. 28. The left and back pockets are identical. The pocket grommets are respectively attached to clevis pins 612L, 612R, 612B, held against the respective walls.

Left and right clevis pins 612L, 612R are identical to those of the preferred embodiment. Housing 618 is a rectangular solid of stiff material, welded to the right wall 606R near the top front, traversed by horizontal hole 620 that aligns with hole 622 in the wall. The right clevis pin is inserted through the alined holes, traverses grommet 672 of pocket 670R, and is fastened with cotter pin 616 inside the pack. The left side is a mirror image.

Back clevis pin 612B is held within housing 613, inserted through angled hole 617. The hole is angled at acute angle 615, such that the clevis pin protrudes from the back wall parallel to the pack wall top edges. The clevis pin traverses hole 622 in back wall 604, the grommet of back pocket 670B, and is fastened with a clevis pin as described above.

Left and right bottom beams 630L, 630R are vertical stiff rectangular members welded vertically to the front wall left and right sides. They extend along the sides from the front wall top end to a distance below the floor on each side. The beam bottom ends are welded respectively to left and right backstops 632L, 632R at obtuse angle 634. The backstops are stiff rectangular members.

The shell pack anchors are identical in structure to those of the preferred embodiment. Left and right inside anchors 644 and outside anchors 642 are welded to the back wall upper edge facing out, located symmetrically about the midpoint. Pallet support tube anchor 626 is welded to the floor front edge facing down. Jar anchor 628 is welded to the right side wall facing out, near the front behind the bolt.

Vertical interior dividing wall 624 divides the shell pack into left and right interior compartments 625L, 625R. The interior dividing wall is welded to the front and back walls left of the midpoints, and to the floor, with the top edge level with the walls. L-shaped ledges 646 are welded around the walls of the left interior compartment 625L, such that the paint cradle 648 top edge is level with the walls as it rests in the interior compartment on the ledges.

Paint cradle 648 is an approximately rectangular container made of stiff material, with floor and walls welded together at the joints. These include floor 649, back wall 650, front wall 652, left and right side walls 654L, 654R, and front and back interior dividing walls 656F, 656B parallel to the front and back walls. The interior dividing walls are fitted with fingertip-sized holes 657 near the upper edges. The paint cradle fits into the left interior compartment, supported on the ledges with sufficient clearance around the clevis pin, cotter pin, and left cord pocket described above.

Crossbracing cords 662L, 662R, 662B are identical to those of the preferred embodiment. The looped middle portion 663 of back crossbracing cord 662B traverses cord lock 666, and bead 664 with a single strand. The ends 667 are fitted with bungee-cord hooks 668, attached with stop knots. The respective crossbracing cords are attached to the shell pack next to the junction with the legs, with the back crossbracing cord traversing wall hole 676 and floor hole 674. The cord ends 667 protrude from the floor hole downward from the shell pack, and the outside loop 663 protrudes back from the wall hole. A short interior segment 678 traverses the inside of the pack between the floor hole and the wall hole. The crossbracing cord configuration on the left and right front corners are identical to the back, located near the respective clevis pins.

Because the shell pack crossbracing cords are attached to the shell pack itself, the legs for the shell pack have no crossbracing cords or crossbracing cord fastener tabs attached, referring to FIG. 2. But the legs, mast, pivoting canvas support rig are otherwise identical to those of the preferred embodiment. Likewise, the rigs, stakes, cords, hatches, quivers, handle, shoulder straps, grommeted straps, holdfasts, stuffsack, straps, waist band, solvent jar, pallet, support tube, and attachments and fasteners for the above, are identical with those of the preferred embodiment. These are not re-illustrated or re-described here, to avoid redundancy.

Operation Of The Shell Pack: Referring also to FIG. 23, it will be seen that the shell pack stands vertically on bottom beams 630L, 630R, with acute angle 610 distributing the weight toward the center. Acute back wall angle 609 positions stuffsack 714 facing back, held by stuffsack straps 705. Canvas 739 is held by holdfast 786, with the lower stretcher bar against the bottom beams and backstops, and the side stretcher bars against stuffsack 714. The holdfast is attached to upper stretcher bar 772 at the top, and to outside anchors 642 at the bottom, similar to the preferred embodiment.

The shell pack is operated similar to the preferred embodiment, with the following exceptions: Once the tripod is erected as in FIG. 4, and the clevis pins are seated respectively on the support arms as in FIG. 1, crossbracing cords 662L, 662R, 662B must be unpacked from their storage configuration in the shell pack.

The storage configuration is as follows. The crossbracing cord ends 667 and outside loops 663 are stored by putting them over the top edge of the shell pack, and stuffing them into the respective cord pockets 670L, 670R, 670B. The cord in the left side pocket is pushed down by the paint cradle, when it is seated in the left interior compartment 625L. Then the pallet is packed on top, and the hatches fastened shut as described above.

To unpack the cords, once the hatches are opened and the pallet is lifted out and set aside, the paint cradle is picked up with fingertip holes 657, and the cords pulled out of the pockets with the other hand. The paint cradle is replaced. The ends of each cord dangle down from the pack, and are fastened to the respective leg anchors in a crossbrace pattern similar to the preferred embodiment in FIG. 1. The shell pack variation is staked to the ground, with staked cords upper ends joined either to the protruding crossbracing cord loops 663, or tied to the junction between the leg and the pack.

The pallet is attached similar to the preferred embodiment, but the support tube is clipped to pallet support anchor 626, and the jar clipped to jar anchor 628. There is no external opening in the pack walls accessible from the outside without opening the hatches, so stakes, cords and rigs must be stored in the pack or in the stuffsack. Brushes are best stored beneath the paint cradle in left interior compartment 625L. The jar, rags, extra paint tubes, stakes rigs and cords in their stuffsack, and support bar are all stored in right interior compartment 625R.

Conclusion

The following theory is disclosed to explain the surprising structural rigidity of the easel system, but this theory is only one possible explanation, and the present inventor does not wish to be bound by it. The combined effects of the rigid bracing member and the crossbraces result in an integral structural unit, with the seated pack frame sandwiched snugly between the tripod legs by the non-resilient crossbracing cords. Because the non-resilient crossbraces and rigid pack frame together make multiple triangular structural connections between every part of the easel system, it is easier to move the entire system than one part separately. The non-resilient crossbraces prevent the lightweight flexible legs from bending in the three respective planes between each adjoining pair of legs, making the easel system tremendously strong for the weight. The easel system only can twist a little, but this has minimal impact on painting and can be mitigated by staking out the easel. Staking out the legs near the junction with the pack frame creates additional structural triangles between the respective leg-middles, bottoms, and the stakes. The crossbraces connect each leg-stake with all three legs at once.

Thus the reader will see that the easel system of the present invention is light but sturdy. The entire system compacts into an easily transported backpack with provision to transport a comprehensive set of art materials. The system provides means to securely hold paint supplies and to conveniently access them from the painting position in front of the easel system, thereby leaving the hands completely free for painting. There are means to rapidly raise and lower the canvas, and a variety of means to hold the entire system steady in wind coming from any direction. In addition to providing painters further access to landscapes, the system adaptably accommodates a wide range of user requirements because the pack and easel can be used separately or together in the studio and classroom. Both small and large canvas can be held on the easel.

While my above description contains many specificities, these should not be construed as limitations on the scope of the invention, but rather as an exemplification of one preferred embodiment and one variation thereof. Many other variations are possible.

The legs and pack frame could be made of any shape of tubing or of I-beams or L-shaped extrusion. They could be made from a wide variety of materials such as molded plastic, aluminum, or carbon fiber tubing. The frame could be molded as a single unit, or in sections. The frame design could be modified by adding structural braces or flanges; or by eliminating the mid-tube, support bars, or back stops. Frames could be fabricated of tubes glued into housings. Pallet storage slots could be built onto the frame, similar the to wet pallet housing, possibly replacing the pallet strap and support tube configuration altogether. The backstops and down tube lower portions could retract or fold on hinges, out of the way. The clevis pins could be taped or glued protruding fully out. The front clevis pins could be welded to the frame, eliminating the hole and cotter pin, or bolts and nuts could be used. The frame could be fabricated from sheet metal, with triangular braces flanges, and corrugated sections for strength.

The frame could attach to the legs with a frame member inserting into a hole in the leg. The pack could be of almost any shape, the sides straight or curved. The pack could be designed with the clevis pins at the bottom of the pack wall, and crossbraces could be attached to the pack or the leg above the junction between the clevis pin and the leg. Additional anchors could be added. Anchors could be fastened with rivets or snap-in fasteners. Key-rings run through paired holes in the tubes could be used instead, or D-rings attached with straps or hose clamps.

Concerning the tripod, there could be four or more legs, similarly supported by crossbraces. The legs could be telescoping or hinged, rather than shock-corded. Leg extensions and their housings could be eliminated completely. Leg extensions could be locked into position with a pin housed inside the leg extension, or outside the leg, fastening through holes in the leg and leg extension. Circular threaded fasteners ringing the leg bottoms could be used to loosen and tighten the clamping slots. A lever configuration on the leg tube with a member going through the tube wall could clamp the leg extension in position with friction. Shock cords could protrude from left and right leg top ends, eliminating the upper segment shock cord holes.

Crossbraces could be of fabric, strap, elastic material, metal, and the like. They could detach from the easel system completely, in several sections or as one long cord with hooks sequentially attached. The hook and anchor arrangement could be replaced by an inserting fastener at the crossbracing cord end, even a simple knot inserting into a slot in or housing on the leg. A variety of hardware such as snap hooks could be used instead of bungee cord hooks. With wide leg tubes, the cord could retract into the legs for storage. They could be wound onto a reel attached to the inside or outside of the leg tube, spring-loaded or manual. Or, the cords could be attached to the pack frame rather than the leg. They could retract into a storage device attached to the pack or pack frame, with means to pull them inside.

Tabs to fasten crossbracing and backstay cords to the easel system could be constructed from other fasteners, such as hooks, snap hooks, elastic cords, straps and the like. The tabs could be attached to the cords themselves. The fastener strips could be attached together and to the leg with rivets, crimps or staples.

The threaded rod at the junction could be replaced with a rigid housing with pivotal thrubolts or rivets. Or it could be a flexible member running through the inside or around the outside of the leg top ends.

The mast could protrude from the housing rather than from a leg. A mast adjustable in height could be attached to the housing, or to a leg(s), with a means to fasten the canvas to the mast top end. There could be a plurality of masts protruding from the legs. The masts could curve, or attach to the canvas at an angle. Mast stays could be plural, joined to several legs.

Concerning the pack body, additional stiffeners, internal compartments, hatches and other closures, detachable external side pockets, and cinching straps could be added. Aligned holes and grommets in the pack body, hatches and paint cradle could be attached with a single blind rivet. Or the paint cradle could be attached to the pack body with a grommet through each pair of aligned holes. The paint cradle could be a simple cloth sling fastened between mid-tube and right pack wall, and attached to the front and back walls; perhaps a single stiff box could be fitted in. Pack body and hatch edges could be attached to the same side of the pack frame tubes. They could be rammed into a slot in the frame, attached with adhesive, or fastened with alternative fasteners, such as snap-in or hook and loop fasteners. An internal pack frame could be used. Handles could be added to hatches, cords and tabs. Quivers could be made less expensively without gaps. The pack straps could be simplified, with two non-adjustable shoulder straps, or even just a handle or single shoulder strap. Padding could be added to the front hatch, to cushion the lower back. The hatches could be eliminated if the pallet were attached on top of the pack frame with nylon hook-and-loop fastener strips, or other fasteners. A waist band could be fitted to the pack, removably attached to grommeted straps identical to grommeted strap 431R described above, the grommeted straps attached side-by-side to the clevis pins. The pack body could be constructed of welded flexible material, instead of sewn.

The quivers could be detachable, attaching to various parts of the pack or frame. The quivered hatch could be fitted with cords and hooks, to secure it in the open position to the legs. A detachable paint cradle could be fastened to the legs or pack frame.

The rigid portions of the pivoting canvas support could be made of a single piece of molded plastic material, eliminating the separate insert, support bar, flange and cotter pin; or the support bar could be inserted into a single stamped housing; in either case the resilient cord assembly would still be separate. The nylon hook-and-loop fastener on the leg tube and handle insert could be replaced by frictional material, possibly in conjunction with an elastic means to hold the handle below the pivot point against the leg. The handle could be furnished with means to clamp onto the leg tube, thereby locking into position. Alternative fastening means could be built into the leg tube surface itself, such as a series of holes, grooves, ridges, depressions, loops or hooks that couple with mating devices in the pivoting supports. The cotter pin and flange could be eliminated, allowing the support bar to rotate. The upper canvas housing rig could be attached to a leg, eliminating the mast.

The pallet support tube could adjust in length with telescoping segments. It could be of shock-corded segments, and possibly fastened to the pallet during transport with nylon hook and loop fastener. It could be attached to an anchor situated on the tripod. The pallet could be lightened with thinner sections bordered by thicker. It could be furnished with holes and other means to hold brushes. The pallet back slots could be attached to the pack frame with simple cords, eliminating the other hardware. The back end could be attached to rigid fastening member protruding from the pack or tripod, or a snap in fastener could attach the pallet to the frame or legs.

The pallet can be attached alternatively to the left or right sides of the pack. For left side attachment, the support tube wingless clip is attached to left side support rod. An extra glove hook is added to the left pallet strap, and clipped to the back tube left outside anchor. The right strap is run around the left front leg, the pallet back edge put on top of the left side tube. The straps are clipped together and adjusted tight, and the front slotted button attached as above. The pallet similarly can be mounted on the right side.

A tray for holding paint supplies could be supported by a support tube, fastened projecting out from a modified version of the pack or shell pack, the modification allowing the tray to fit into the pack for transport, with the pallet resting on top of it.

A clamping unit similar to a "c" clamp could be used to clamp the stretcher bar inside and outside edges, with at least one member hooking over the stretcher bar front wall. The inside and outside hooks could be wider. They could be joined together in a single integrated unit. Two-inside hooks could be rigged similar to the transverse wind rig in FIG. 20, and used to secure the canvas bottom edge to the down tubes during transport. Hooks could be furnished with handles. Rings could be replaced by a knotted cord loop, and cord locks could be eliminated.

An auxiliary triangular insert could be constructed of shock-corded tubes, with bent elbows or housings at the corners. A large canvas could be transported with a rigid member between the side stretcher bars hooked over the backstops, the canvas protruding above and below the rigid member.

The wet pallet housing could be fitted with a handle, on one side or across the open front end, with a fastening means to lock the pallet inside. The roof itself could be arched, with no interior arches or back wall. The housing could be molded in one piece.

Shell pack interior compartments could be multiple. Sized holes in the floor could hold the brush handles. The beams could be eliminated if the shell pack is vertically balanced, with a hinged shelf folding out from the back wall at an acute angle, with the canvas wedged into the angle. Anchors, clevis pins and bottom beams could be molded integral with the box. Crossbracing cords could be pulled in from the inside, perhaps with an internal reel, so that the hooks protruding from the outside could be easily pulled out without opening the pack. The paint cradle could be fitted with suspending fastener system and attached to the outside shell pack wall. A shell pack could be built with a basket, a bucket, or tray, a bowl, or any stiff container, even a paint roller pan. The walls and floor could be flat or curved. The shell pack could be seated in a tripod with the crossbracing cord upper portions attached to the legs as in FIG. 2.

Accordingly, the scope of the invention should be determined not by the embodiments illustrated, but by the appended claims and their legal equivalents.

I claim:

1. A portable easel system:

a plurality of at least three legs, said plurality being joined at the top end and being capable of being spread at the bottom end, each of said legs being formed of a plurality of interconnecting segments;

a rigid bracing member suspendable between each adjacent pair of legs for holding said legs in a fixed open position, said member being positioned approximately midway on said legs;

a plurality of flexible non-resilient crossbraces coupled between the approximate bottom end of each of said legs and the approximate junction between each adjacent leg and said rigid bracing member.

2. The portable easel system claimed in claim 1, wherein said crossbraces are coupled between said approximate bottom end of each of said legs and the approximate middle of each adjacent leg, close to said junction.

3. The portable easel system claimed in claim 1, wherein said crossbraces are coupled between said rigid bracing member near said junction with each of said legs, and said approximate bottom end of each adjacent leg.

4. The portable easel system claimed in claim 1, further including an elastic resilient cord traversing said segments in each leg, whereby said segments easily snap together to form said leg.

5. The portable easel system claimed in claim 4, further including means to adjust said resilient cord.

6. The portable easel system claimed in claim 1, further including means to adjust the length of said crossbraces and said legs, whereby said easel system can be adjusted for each individual painter and adapted to the terrain.

7. The portable easel system claimed in claim 1, further including means to detach at least one end of each of said crossbraces from said easel system.

8. The portable easel system claimed in claim 7, further including means to fasten the detached crossbraces to said easel system, whereby said means decrease the likelihood said detached crossbraces becoming entangled.

9. The portable easel system claimed in claim 8, wherein said means include mating strips of nylon hook and loop fastener attached to said easel system, wherein said detached crossbraces are fastened between said mating strips.

10. The portable easel system claimed in claim 1, further including means to support a canvas against two of said legs, wherein said means pivot respectively against said legs, pivoting between an attached position whereby said means are respectively fastened to said legs with a fastening means, and a detached position whereby said means respectively slide along said legs while supporting said canvas, whereby said canvas can be rapidly repositioned for painting.

11. The portable easel system claimed in claim 10, wherein said fastening means comprises mating strips of nylon hook and loop fastener attaching said supporting means to said legs.

12. The portable easel system claimed in claim 11, further including means to fasten said canvas to said supporting means, whereby said canvas is secured in the wind.

13. The portable easel system claimed in claim 11, wherein said fastening means further include means to fasten said canvas to said leg.

14. The portable easel system claimed in claim 1, wherein at least one of said legs extends above the junction of said plurality of legs to form a mast for supporting a canvas.

15. The portable easel system claimed in claim 14, further including means to stay said mast.

16. The portable easel system claimed in claim 14, wherein said mast further includes an adjustable resilient cord traversing said mast and a portion of said leg, whereby said mast is easily snapped into position.

17. The portable easel system claimed in claim 1, further including means to clamp the inside and outside edges of a canvas stretcher bar, wherein at least one member of said means hooks over the front wall of said stretcher bar, and further including a cord to join said clamping means to a fixed object, whereby said canvas is made stable for painting.

18. The portable easel system claimed in claim 17, wherein said clamping means comprises two hooks joined by a cord, seated respectively on said inside and outside edges, wherein said cord joins said hooks to said fixed object.

19. The portable easel system claimed in claim 17, wherein said clamping means is joined to a mast extending above the junction of said plurality of legs, wherein said clamping means slide along said mast.

20. The portable easel system claimed in claim 1, further including means to join said approximate junction of each of said legs and said rigid bracing member to a fixed object, whereby said easel system is made more stable for painting.

21. The portable easel system claimed in claim 1, wherein said rigid bracing member forms a portion of a pack frame, wherein said pack frame can be removed from said legs.

22. The portable easel system claimed in claim 21, further including means for holding said plurality of legs and said mast in a folded state, a canvas held against a supporting member, paint supplies and the like, and stakes, rigs and cords.

23. The portable easel system claimed in claim 21, further including means to hold all of said paint supplies and the like accessible from the painting position in front of said easel system, whereby painting is made easier.

24. The portable easel system claimed in claim 21, further including means to attach a pallet projecting in a horizontal position outward from said pack frame.

25. The pallet claimed in claim 24, wherein said pallet adjusts from said horizontal position to a vertical position, whereby the painter can work close to the canvas without removing said pallet from said easel system.

26. The portable easel system claimed in claim 22, further including means to protect at least one surface of said pallet from mechanical contact during transport, whereby mixed paint can be conserved during transport.

27. The portable easel system claimed in claim 21, further including means protect from mechanical contact the paint-charged ends of paint brushes, whereby the paints remain uncontaminated.

28. The portable easel system claimed in claim 1 wherein said rigid bracing member forms a portion of a container, wherein said container can be removed from said legs.

29. The portable easel system claimed in claim 28, wherein said container is a box.

30. The portable easel system claimed in claim 28, further including shoulder straps to transport said container strapped to a human.

31. The portable easel system claimed in claim 1, wherein said rigid bracing member forms a portion of a horizontal member, wherein said horizontal member can be removed from said legs.

* * * * *